US009833656B2

(12) United States Patent
Hockridge et al.

(10) Patent No.: US 9,833,656 B2
(45) **Date of Patent: *Dec. 5, 2017**

(54) EXERCISE MACHINE FOR MOVABLE USER SUPPORT

(71) Applicant: Hoist Fitness Systems, Inc., Poway, CA (US)

(72) Inventors: Bruce Hockridge, San Diego, CA (US); Jeffrey O. Meredith, Del Mar, CA (US); Thao V. Doan, Oak Park, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/456,837

(22) Filed: Mar. 13, 2017

(65) Prior Publication Data

US 2017/0182354 A1 Jun. 29, 2017

Related U.S. Application Data

(63) Continuation of application No. 13/946,446, filed on Jul. 19, 2013.

(Continued)

(51) Int. Cl.
*A63B 26/00* (2006.01)
*A63B 21/00* (2006.01)

(Continued)

(52) U.S. Cl.
CPC ..... *A63B 21/4049* (2015.10); *A63B 21/063* (2015.10); *A63B 21/4035* (2015.10);

(Continued)

(58) Field of Classification Search
CPC ..... A63B 21/00065; A63B 21/00069; A63B 21/00087; A63B 21/0009;

(Continued)

(56) References Cited

U.S. PATENT DOCUMENTS 3,207,464 A 9/1965 Hrach
3,367,613 A 2/1968 Christensen (Continued)

FOREIGN PATENT DOCUMENTS

DE 20317170 U1 3/2004
DE 202011102658 U1 11/2011

(Continued)

OTHER PUBLICATIONS

03008 Abdominal Machine, Gym 80 Brochure, date unknown, admitted as prior art for this application, 1 page.

(Continued)

*Primary Examiner* — Andrew S Lo
(74) *Attorney, Agent, or Firm* — Gordon Rees Scully Mansukhani LLP; David R. Heckadon

(57) ABSTRACT

An exercise machine with a two directional pivoting user support assembly has a user support or platform which supports the user and pivots about a first pivot axis during an exercise movement, and is also pivotable about at least one second pivot axis to involve the user's core muscles in balancing and maintaining the user support in a stable position. A manually operable locking device with a simple flip switch lever is provided for selectively locking the user support against rotation about the second pivot axis, so that the user can easily chose whether to perform the exercise with a stable support or to add a level of difficulty by using the unstable seat mode and exercising core muscles during the exercise.

20 Claims, 19 Drawing Sheets

Related U.S. Application Data

(60) Provisional application No. 61/681,018, filed on Aug. 8, 2012.

(51) Int. Cl.
*A63B 21/062* (2006.01)
*A63B 23/00* (2006.01)

(52) U.S. Cl.
CPC ..... *A63B 21/4039* (2015.10); *A63B 23/00* (2013.01); *A63B 2023/003* (2013.01); *A63B 2208/0214* (2013.01)

(58) Field of Classification Search
CPC ..... A63B 21/00094; A63B 21/00109; A63B 21/0012; A63B 21/00123; A63B 21/00127; A63B 23/02; A63B 23/0205; A63B 23/0211; A63B 23/0216; A63B 23/0222; A63B 23/0227; A63B 23/035; A63B 23/03516; A63B 23/03525; A63B 23/04; A63B 23/0405; A63B 23/0482; A63B 23/0494; A63B 23/12; A63B 23/1209; A63B 23/1245; A63B 23/1281; A63B 26/00; A63B 23/03575
USPC ..... 482/142
See application file for complete search history.

(56) References Cited

U.S. PATENT DOCUMENTS

| | | | |
|---|---|---|---|
| 3,999,702 | A | 12/1976 | Conroy |
| 4,387,893 | A | 6/1983 | Baldwin et al. |
| 4,456,245 | A | 6/1984 | Baldwin et al. |
| 4,623,144 | A | 11/1986 | Rockwell |
| 4,627,619 | A | 12/1986 | Rockwell et al. |
| 4,729,562 | A | 3/1988 | Pipasik |
| 4,836,536 | A | 6/1989 | Jones |
| 5,007,675 | A | 4/1991 | Musto et al. |
| 5,052,684 | A | 10/1991 | Kosuge et al. |
| 5,056,779 | A | 10/1991 | Webb |
| 5,094,449 | A | 3/1992 | Stearns et al. |
| 5,167,364 | A | 12/1992 | Wenning |
| 5,284,461 | A | 2/1994 | Wilkinson et al. |
| 5,346,447 | A | 9/1994 | Stearns |
| 5,360,383 | A | 11/1994 | Boren |
| 5,577,987 | A | 11/1996 | Brown |
| 5,665,041 | A | 9/1997 | Hsieh et al. |
| 5,669,865 | A | 9/1997 | Gordon et al. |
| 5,681,250 | A | 10/1997 | Hoover et al. |
| 5,692,997 | A | 12/1997 | Stearns |
| 5,702,332 | A | 12/1997 | Hsieh et al. |
| 5,749,813 | A | 5/1998 | Domzalski |
| D408,875 | S | 4/1999 | Anderson |
| 5,902,220 | A | 5/1999 | Lin |
| 5,938,575 | A | 8/1999 | Stearns et al. |
| 6,003,944 | A | 12/1999 | Glockl |
| 6,015,370 | A | 1/2000 | Pandozy |
| 6,168,557 | B1 | 1/2001 | Liao |
| 6,186,926 | B1 | 2/2001 | Ellis |
| 6,248,047 | B1 | 6/2001 | Abdo |
| 6,379,289 | B1 | 4/2002 | Gossie |
| 6,468,191 | B1 | 10/2002 | Cameron |
| 6,475,120 | B2 | 11/2002 | Johnston |
| 6,475,123 | B1 | 11/2002 | Evans |
| 6,478,721 | B1 | 11/2002 | Hunter |
| 6,491,611 | B1 | 12/2002 | Stearns |
| RE38,057 | E | 4/2003 | Pandozy |
| 6,544,154 | B2 | 4/2003 | Forcillo |
| 6,575,884 | B1 | 6/2003 | Eazor |
| 6,676,573 | B2 | 1/2004 | Abelbeck et al. |
| 6,752,748 | B1 | 6/2004 | Scotti |
| 6,966,872 | B2 | 11/2005 | Eschenbach |
| D513,293 | S | 12/2005 | Panatta |
| D520,084 | S | 5/2006 | McVay et al. |
| 7,090,628 | B2 | 8/2006 | Badarneh |
| 7,115,081 | B2 | 10/2006 | Stearns |
| 7,150,702 | B2 | 12/2006 | Webb et al. |
| 7,220,221 | B2 | 5/2007 | Mosimann et al. |
| 7,494,181 | B2 | 2/2009 | Tucker |
| 7,621,860 | B2 | 11/2009 | Burrell |
| 7,717,832 | B2 | 5/2010 | Webber et al. |
| 7,760,269 | B2 | 7/2010 | Ochs et al. |
| 7,766,802 | B2 | 8/2010 | Webber et al. |
| 7,794,371 | B2 | 9/2010 | Webber et al. |
| 7,867,149 | B1 | 1/2011 | Webber et al. |
| 7,901,337 | B2 | 3/2011 | Webber et al. |
| 7,938,760 | B1 | 5/2011 | Webber et al. |
| 7,976,440 | B2 | 7/2011 | Webber et al. |
| 7,981,010 | B1 | 7/2011 | Webber et al. |
| 7,993,251 | B1 | 8/2011 | Webber et al. |
| 8,172,732 | B1 | 5/2012 | Webber et al. |
| 2004/0204298 | A1 | 10/2004 | Chen |
| 2005/0168017 | A1 | 8/2005 | Pernicka et al. |
| 2006/0166799 | A1 | 7/2006 | Boland et al. |
| 2006/0211549 | A1 | 9/2006 | Nohejl |
| 2007/0213187 | A1 | 9/2007 | Morgan |
| 2008/0085822 | A1 | 4/2008 | Webb et al. |

FOREIGN PATENT DOCUMENTS

| | | | |
|---|---|---|---|
| GB | 2341331 | A | 3/2000 |
| JP | 2010-284236 | A | 12/2010 |

OTHER PUBLICATIONS

07008 Abdominal Machine, Gym 80 Brochure, 2001, 2 pages.
08005 Abdominal Multi-Joint Machine, Gym 80 Brochure, 2001, 1 page.
712 Abdominal isolator, Icarian Brochure, date unknown, admitted as prior art for this application, 1 page.
Ab Coaster, Advertisement, date unknown, admitted as prior art for this application, 2 pages.
AB Doer Extreme, web page, http://www.asseenontv.com/prod-pages/ab.sub.—doer.sub.—xtrm.html?gid=, printed Jun. 25, 2008, earliest date unknown, 1 page.
AB Lounge, web page, http://ecx.images-amazon.com/images/l/4165nz401SI.SS500, printed Jun. 25, 2008, earliest date unknown, 1 page.
AB Rocket Abdominal Trainer, Amazon.com, http://www.amazon.com/gp/product/images/BOOOSALE1Q/ref=dp.sub.—otherview—s.sub.—3?ie=UTF, printed Jun. 25, 2008, earliest date unknown, 3 pages.
AB Zone. web page. http://www.asseenonlv.com/prod-pages/abzne.sub.—onlv.html. printed Jun. 25, 2008. earliest dale unknown. 1 page.
Abcore. Abcore Fitness 2005. web page. http://www.filnessabcore.com/photos.hlm#. printed Jan. 5, 2006. earliest dale known. 1 page.
Body Flex Clark Bartram's 3D Abs. web page. http://www.amazon.com/gp/product/images/B0007U9CRU/ref=dp.sub.—otherview—s.sub.—1?ie=UTF. printed Jun. 25, 2008. earliest dale unknown. 4 pages.
Cybex Ab Crunch. Cybex Brochure 2001. 1 page.
F-609 Abdominal Machine and F-611 Ab Flexor. Flex Brochure 1995. 1 page.
Hoist HS1350 Rotary Torso and HS1310 Ab Crunch. Hoist Fitness Systems Brochure. 2005. 1 page.
Multi-Hinge Ab Crunch. Amazon.com. http://www.ecx.images-amazon.com/images/l/31 MoMOIJHbL.sub.—SS500.jpg. printed Jun. 25, 2008. earliest dale unknown. 1 page.
Posi-trak Work-Out Bench. Positrak Brochure. dale unknown. Cited by other. 1 page.
Abdominal Machine. Nautilus Brochure. 1997. 1 page.
Power Crunch. Quantum Brochure. 2004. 2 pages.
Red Seat. web page. http://ecx.images-amazon.com/imagesl/41 FAV4zc!WI.SS500.jpg. printed Jun. 25, 2008. earliest dale unknown. 1 page.
Star Trac Instinct Rotary Torso, Source 1 Medical, http://web.archive.org/20101102183507/http://www.source1.medical.com/Siar-Trac-Instinct-Rotary-Torso, Nov. 2001, 3 pages.

(56) References Cited

OTHER PUBLICATIONS

Hoist S602 Rotary Torso, Hoist Customer Catalog, Sep. 1997, 6 pages.
Swedish Abdominal Twister Model 3660, dale unknown, admitted as prior art for this application, 1 page.
Partial European Search Report for related EP Application No. 13150819A, dated Jul. 24, 2013, in 5 pages.
Extended European Search Report dated Oct. 8, 2013 for related EP Patent Application No. 13150819.4 in 11 pages.

EXERCISE MACHINE FOR MOVABLE USER SUPPORT

CROSS-REFERENCE TO RELATED APPLICATIONS

This application is a continuation of U.S. patent application Ser. No. 13/946,446, filed Jul. 19, 2013, which claims the benefit of U.S. Provisional Patent Application No. 61/681,018, filed Aug. 8, 2012, each of which is incorporated herein by reference in its entirety for all purposes.

BACKGROUND

1. Field of the Invention

This invention relates generally to exercise machines and is particularly concerned with exercise machines having two directional pivoting user supports.

2. Related Art

User supports which support an exerciser in seated, prone, kneeling, or upright positions while performing an exercise on an exercise machine are known. Such supports may be stationary, or may be designed to rock during an exercise. In a rotary torso exercise machine, a user support is mounted for rotation about a vertical axis and the user rotates their lower torso relative to their upper torso to the right and left of a central position.

Some user supports are rotatable about a second pivot axis during exercise so as to exercise a user's core muscles, for example the abdominal exercise machine described in U.S. Pat. No. 8,172,732 of Webber et al.

SUMMARY

In one aspect, an exercise machine with a two directional pivoting user support assembly is provided, in which a user support or platform which supports the user pivots about a first pivot axis during an exercise movement, and is also pivotable about at least one second pivot axis to involve the user's core muscles in balancing and maintaining the user support in a stable position. Thus, the user support is unstable about the second pivot axis. In one embodiment, a manually operable locking device is provided for releasably locking the user support against rotation about the second pivot axis, so that the user can easily chose whether to lock the user support and perform the exercise with a stable support or to add a level of difficulty by releasing the lock and allowing the seat to rock in an unstable seat mode, requiring the exerciser to use core muscles during the exercise to hold the support in a level position.

In one embodiment, the user support assembly comprises a base which is rotatable about the first pivot axis, and the user support is pivotally mounted on the base for rotation about at least one second pivot axis non-parallel to the first pivot axis, adding instability to the user support or platform during the exercises. A manually operable locking mechanism is provided between the base and user support, comprising a first lock part having an opening and a second part comprising a releasable locking pin movable between a locked position engaging the opening to prevent rotation of the user support about the second pivot axis and an unlocked position retracted from the opening. In one embodiment, the first lock part may be a lock plate or bracket located under the user support and the second part is mounted on the base. A manually engageable lock tab or switch lever is rotatable between first and second positions to extend and retract the locking pin.

The user support may be designed for supporting a user in a seated or kneeling position while performing an exercise on an exercise machine, and may be pivotally mounted on the base for side to side pivoting motion about a pivot axis beneath the user support platform, or for side to side tilting or swiveling motion about a pivot axis extending transversely through the user support. In one embodiment, a pair of bumper pads may be provided on the base on opposite sides of the pivot axis for engaging the user support pad to limit rotation of the user support pad in each direction to a predetermined angular range.

In one embodiment, an unstable, tiltable user support is designed for supporting a user in a kneeling position, and may be provided on a rotary torso exercise machine. The rotary torso machine in one embodiment comprises a main frame, a user lower torso support rotatably mounted on the frame for rotation about a first, vertical axis, and an upper torso support mounted on the frame for supporting the upper torso in a fixed position while the lower torso is rotated. The lower torso support comprises the unstable user support and is also pivotally mounted for limited rotation about a horizontal pivot axis so that the user has to balance the support while performing the rotating or twisting exercise motion. This produces a greater engagement of the user's core muscles in maintaining the user support in a horizontal plane while rotating their lower torso about a central vertical axis. The addition of the releasable locking mechanism allows the user to select whether or not to use core muscles during the exercise.

In another embodiment, the exercise machine is an abdominal exercise machine, and the base is pivoted on a frame for rotation about the first pivot axis, and the user support is pivotally mounted on the base for rotation about the second pivot axis transverse to the seat in which the user's lower torso pivots from side to side from a central position. An exercise arm is pivotally mounted on the frame for rotation about a third pivot axis parallel to the first pivot axis, and a connecting link is provided between the exercise arm and user support base so that movement of the exercise arm automatically moves the user support in a first direction to perform an abdominal exercise. In this embodiment, the locking mechanism is provided between the base and user support seat and can be controlled by the user to lock the user support seat relative to the base so that exercises are performed on a stable user support. When the mechanism is unlocked, the user support is freely rotatable about the second pivot axis during the abdominal exercise, and this movement is controlled by the user using core muscles to maintain the user support in a steady position.

In another embodiment, an unstable user support may be provided on any one of a plurality of different upper torso machines or other exercise machines to support a user in an exercise position while performing an exercise, so the user employs core muscles to hold the seat level while exercising selected muscles. The unstable user support may be provided on an arm exercise machine, a shoulder press exercise machine, a chest exercise machine, a pee fly exercise machine, or a seated mid row exercise machine, or other types of exercise machine in which the user is supported in a seated, kneeling, or other exercise position. Unstable user supports may also be designed in a similar way for supporting users in other exercise positions in other alternative embodiments, such as prone or standing positions.

The releasable locking mechanism or device is easily operated manually by the user for movement between the locked and unlocked positions when positioned on or off the user support, simply by turning or flipping a lock control tab or switch lever between first and second positions with their finger or thumb.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for an exercise machine with a two directional pivoting user support assembly, in which a user support or platform which supports the user in an exercise position pivots about a first pivot axis during an exercise movement, and is also pivotable about at least one second pivot axis to involve the user's core muscles in balancing and maintaining the user support in a stable position. Thus, the user support is unstable about the second pivot axis. In one embodiment, a manually operable locking device is provided for releasably locking the user support against rotation about the second pivot axis, so that the user can easily chose whether to perform the exercise with a stable support or to add a level of difficulty by using the unstable seat mode and exercising core muscles during the exercise.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1A:
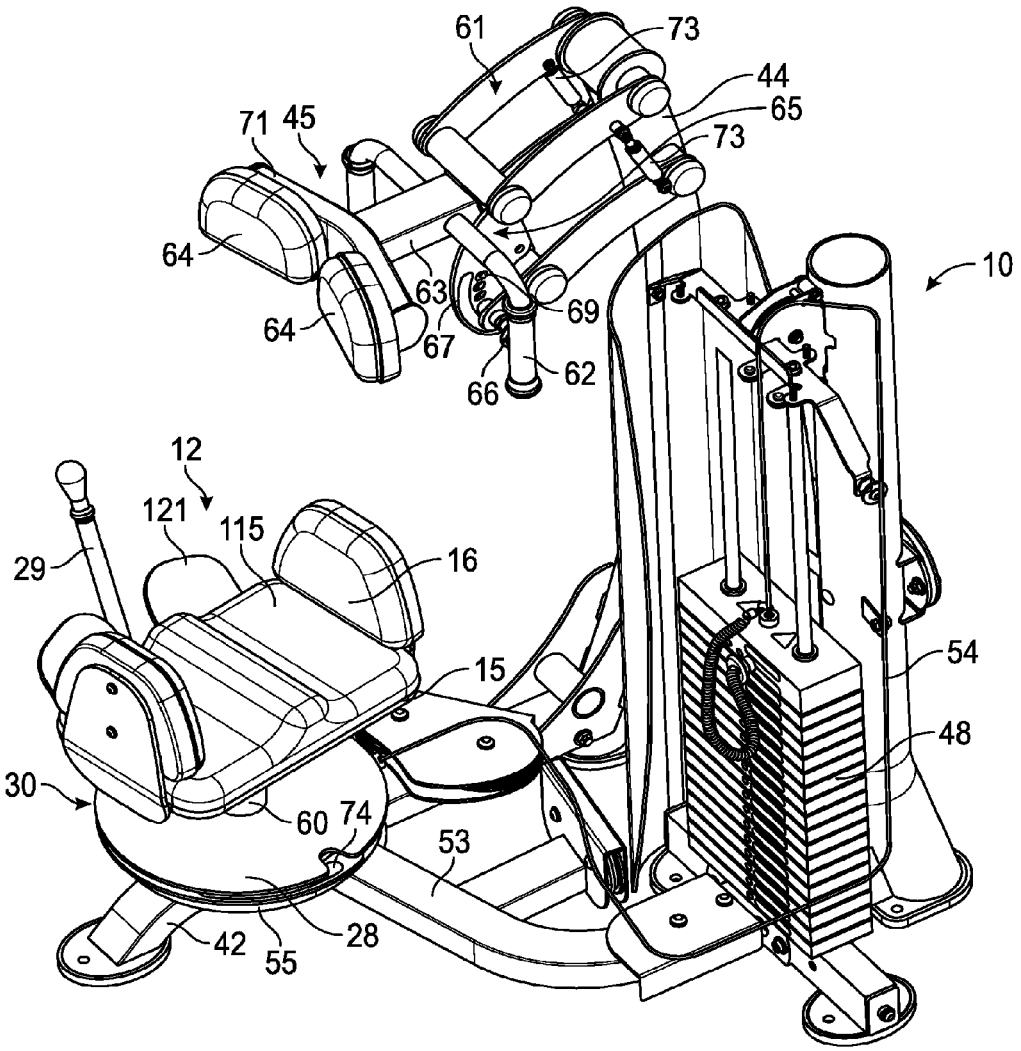
FIG. 1A is a perspective view of a rotary torso exercise machine incorporating a user support assembly according to a first embodiment, with a user support rotatable about first and second different pivot axes and shown in a first position at the start of a rotary torso exercise.
Figure 1B:
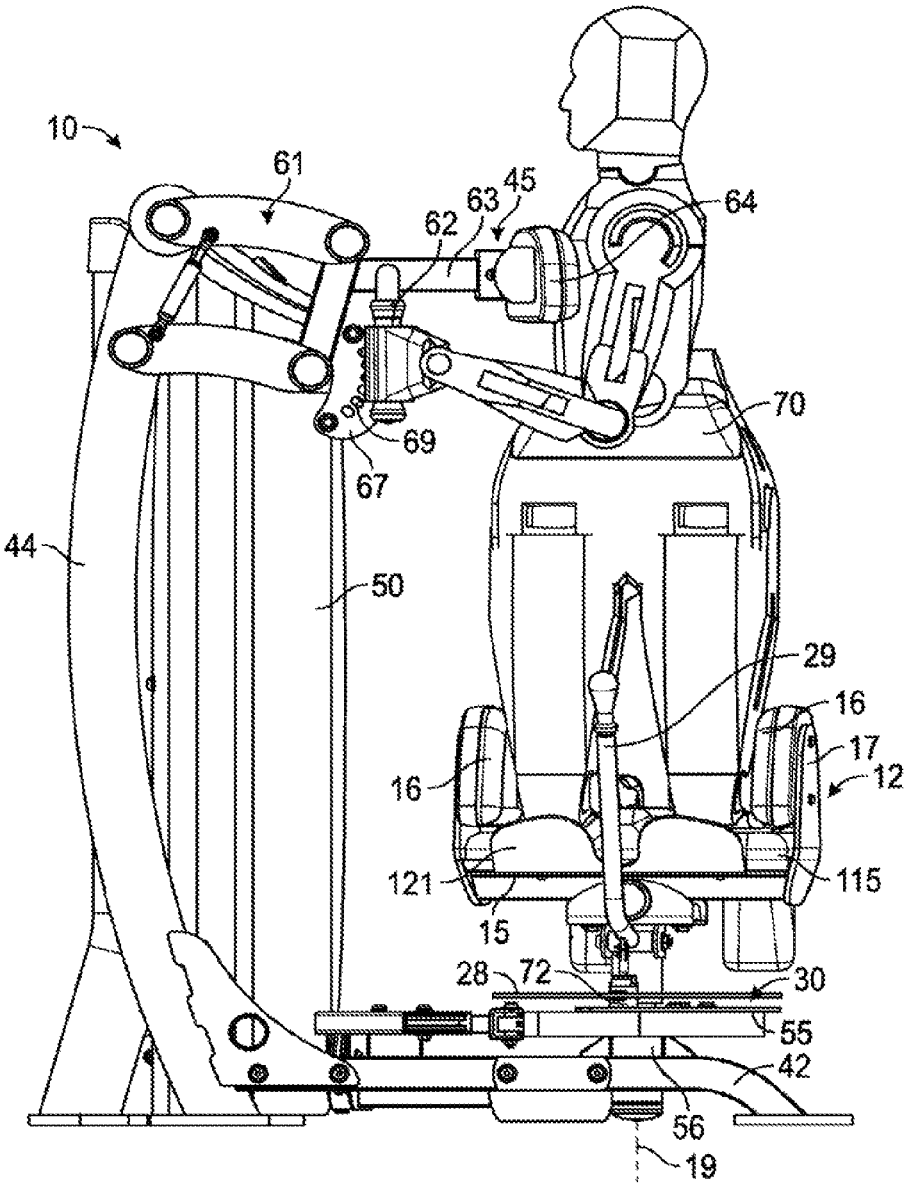
FIG. 1B is a front elevation view of the rotary torso exercise machine in the position of FIG. IA, with a user kneeling on the user support and twisting their upper torso to engage the upper torso support assembly.
Figure 1C:
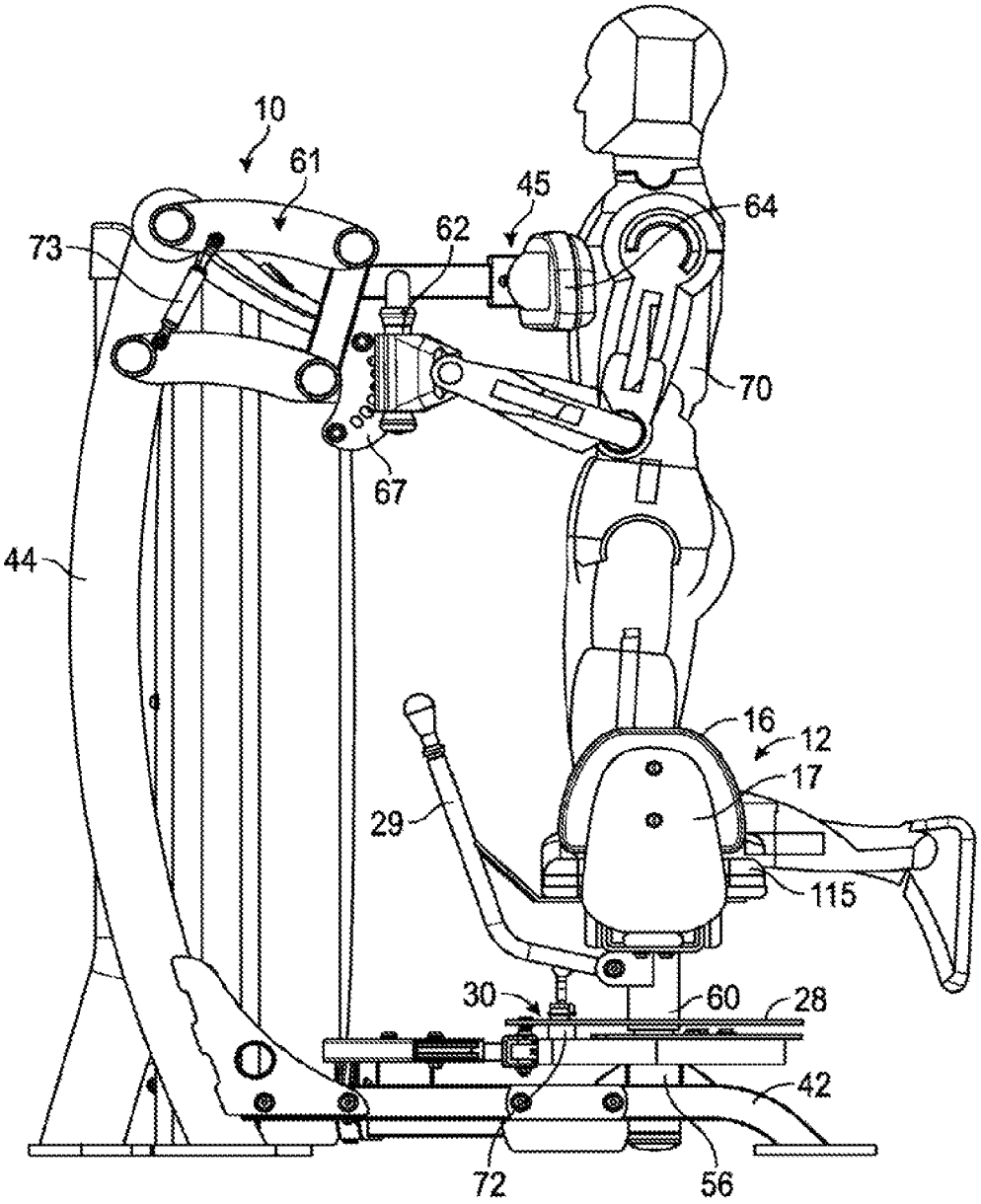
FIG. 1C illustrates the user support assembly and user at the end position of a rotary torso exercise.
Figure 2:
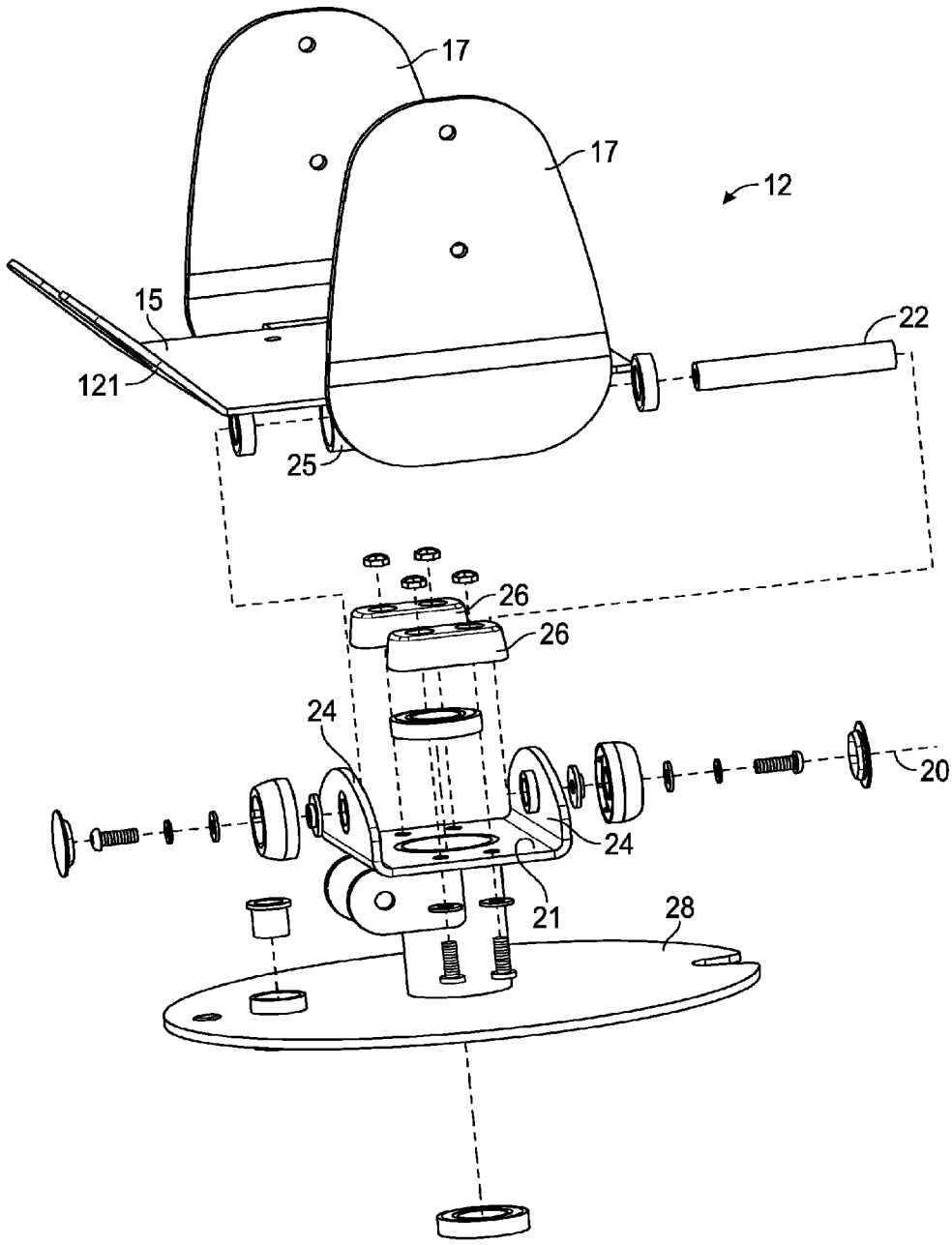
FIG. 2 is an exploded view of the components of the user support assembly of FIG. 1A to IC.

FIGS. 1A to 2 illustrate a first embodiment of an exercise machine 10 incorporating a pivoting user support assembly 12 rotatable about two or more axes, while FIGS. 3 to 10 illustrate a second embodiment of the user support assembly 12A which may replace assembly 12 of the machine of FIGS. 1A to 2. User support assembly 12A is modified to incorporate a manually operable locking device or mechanism 14, but is otherwise identical to user support assembly 12 of FIGS. 1A to 2. Locking mechanism 14 is configured to releasably lock user support or platform 15 against rotation about the second pivot axis, as described in more detail below. One embodiment of locking mechanism 14 is illustrated in more detail in FIGS. 11 to 16. However, other locking devices or mechanism may be used in alternative embodiments.

Exercise machine 10 of FIGS. 1A to 1C is a rotary torso machine. However, locking mechanism 14 may be incorporated in other exercise machines having pivoting user supports with more than one direction of rotation in other embodiments, such as an arm exercise machine, a shoulder press exercise machine, a chest exercise machine, a pee fly exercise machine, a seated mid row exercise machine, or an abdominal exercise machine as illustrated in FIGS. 17 to 22, or other types of exercise machine with rocking or pivoting user supports in which the user is supported in a seated or kneeling position.

The user support assembly 12 or 12A is designed to support a user in a kneeling position, but it should be understood that the device may alternatively be designed for supporting users in different positions, such as seated positions, for example as shown in the second embodiment described below in connection with FIGS. 17 to 22. The kneeling user support assembly 12 or 12A may also be incorporated on other exercise machines in which a user performs an exercise in a kneeling position.

Apart from the locking mechanism 14, the user support assembly of FIGS. 3 to 10 is identical to the user support assembly of FIGS. IA-IC and 2 as described in detail in co-pending application Ser. No. 13/491,256 filed on Jun. 7, 2012, the contents of which are incorporated herein by reference. Unstable user support assembly 12 basically comprises a base 28 and user support or platform 15 mounted on base 28 via support post 60 and support bracket 21 secured to the upper end of post 60, as best illustrated in FIG. 2. Base 28 is rotatably mounted on stationary frame member or plate 55 for rotation about a first, vertical pivot axis 19 (see FIG. IB and IC). A kneeling pad 15 and side support pads 16 are mounted on user support 15 as illustrated in FIGS. 1A to 1C. The side support pads 16 are mounted on side support plates 17 on opposite side ends of the user support platform. User support platform 15 is rotatably mounted on bracket 21 via a pivot connection 18 for rotation about a second, horizontal pivot axis 20 beneath platform 15 which is aligned with the direction of the user's knees when kneeling on the user support and parallel to the plane of platform 15. As best illustrated in FIG. 2, the pivot connection 18 comprises a pivot pin 22 secured between end plates or portions 24 of U-shaped bracket 21 and rotatably engaged in pivot sleeve 25 secured to the lower surface of user support platform 15. A pair of bumper pads 26 which may be of rubber or the like are secured to the mounting bracket 21 on opposite sides of the pivot axis, as best illustrated in FIG. 2.

Mounting bracket 21 is designed for attaching to a user support mounting post or other mounting device on an exercise machine, in place of a conventional, stable user support, such as the user support of a rotary torso machine or any other exercise machine designed for users to perform exercises in a kneeling position. In the illustrated embodiment, mounting bracket 21 is secured to base 28 via mounting post 60. An angled guide 121 with a notch 23 for receiving a rotational range adjust lever 29 projects from the forward end of user support platform 15, as illustrated in FIGS. 1A, 1B and 2, but guide 121 may be eliminated in alternative embodiments of the unstable user support.

Figure 10:
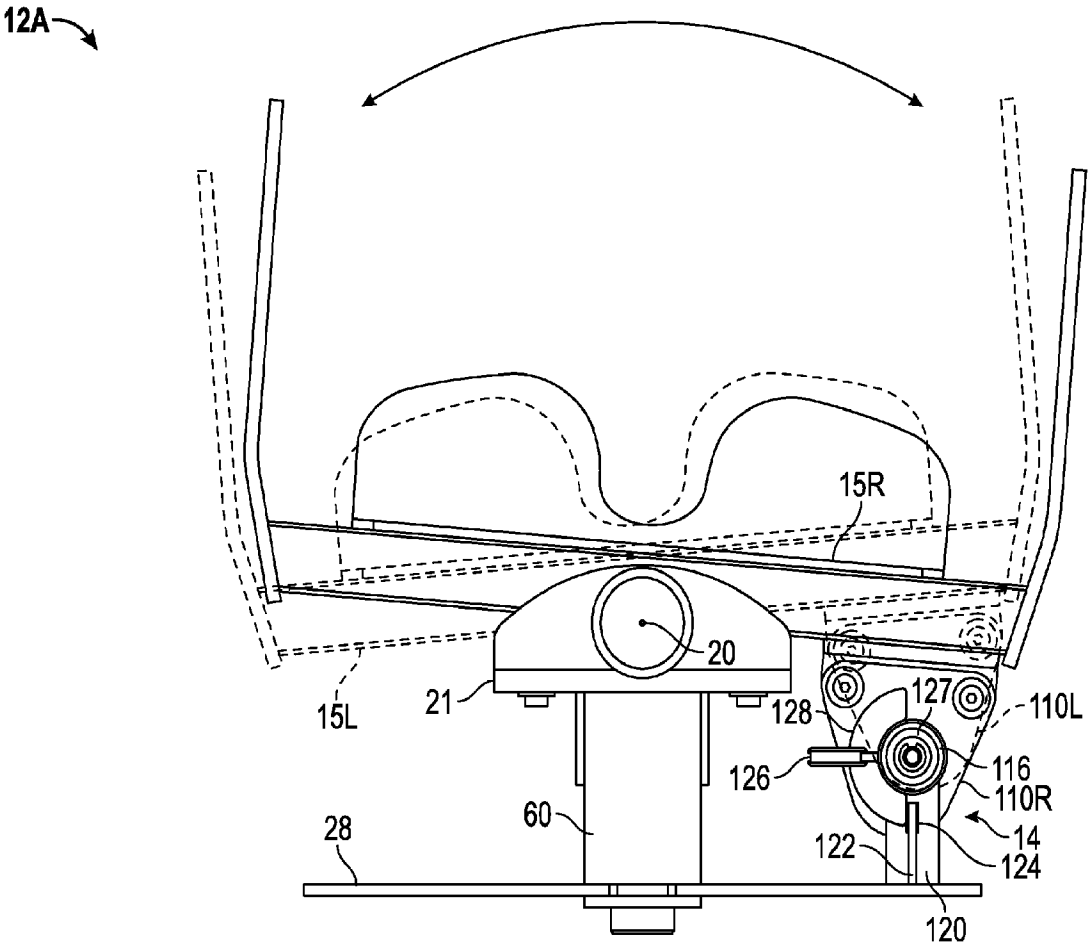
FIG. 10 is a front elevation view of the modified user support assembly similar to FIG. 8 but illustrating the horizontal, right and left tilted positions of the user support platform in dotted outline.
Figure 11:
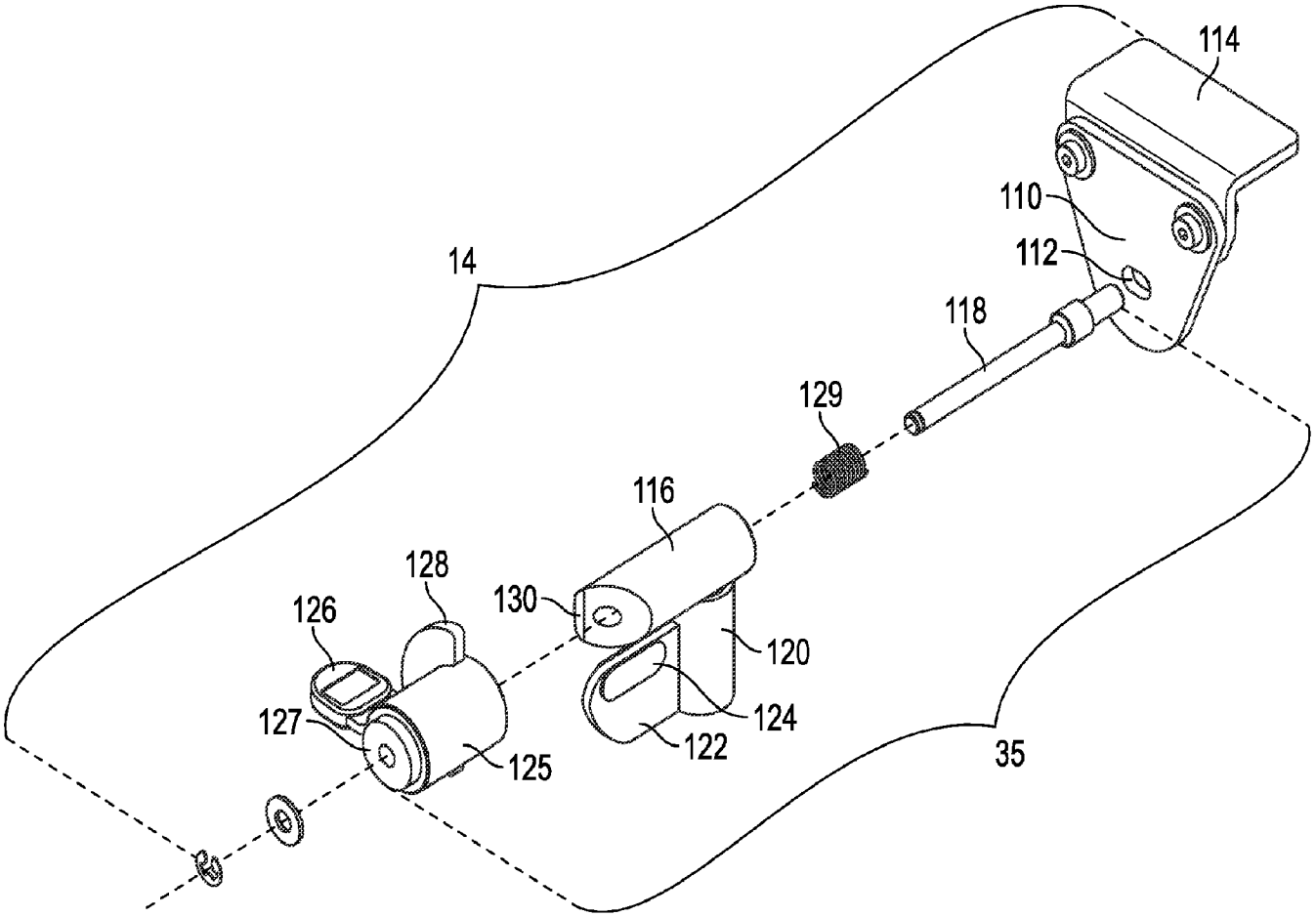
FIG. 11 is an exploded view of the components of one embodiment of the locking mechanism.

The user support platform 15 of the unstable user support device 12 can pivot from side to side relative to support bracket 21 about the horizontal pivot axis 20 by an amount determined by the height of rubber bumper pads or stops 26. Modified user support device 12A can also pivot or rock from side to side in the same manner when the manually operable locking mechanism 14 is in the unlocked condition. FIG. 10 illustrates the right and left tilted end positions of the user support platform 15 in dotted outline, with reference numbers ending in an R representing rotation to the right (clockwise as viewed in FIG. 10) and reference numbers ending in an L representing rotation to the left (anti-clockwise as viewed in FIG. 10). Thus, the user support platform in the illustrated embodiment has a degree of instability of five degrees off horizontal from side to side. In the illustrated embodiment, the user support can pivot down to the left or the right about axis 20 through an angle of 0 to around 5 degrees in either direction before contacting a bumper pad or stop 26, as illustrated in dotted line in FIG. 10. When locking mechanism 14 is in the unlocked or rocking position, a user kneeling on the user support must use core muscles in order to maintain the platform in a stable, horizontal position while performing an exercise. FIGS. 3 to 9 illustrate a balanced, centered or 0 degrees orientation of the user support platform 15 in which the platform does not contact either bumper pad, and the platform may be locked in this position by locking mechanism 14 if desired by the user, as described in more detail below.

Although the user support platform tilts from side to side about a horizontal pivot axis extending in a front to rear direction in the illustrated embodiments, other embodiments may have different pivot joints between platform 15 and mounting bracket 21 to allow pivoting about different pivot axes or in different planes, for example a universal joint to provide instability in all directions, or a horizontal pivot axis perpendicular to axis 20 to permit pivoting down at the front and rear of the platform 15. Additionally, although the user support platform is oriented horizontally in the illustrated embodiment, it may be slightly tilted or angled downwards or upwards when mounted on an exercise machine support structure in other embodiments, depending on the type of exercise. In such alternatives, the axis 20 is not horizontal but extends parallel to the plane of the user support platform, and the platform still tilts or rocks from side to side about the axis 20. In each of these alternatives, the platform of user support assembly 12A may be locked in a single, central position to prevent tilting if desired by the user.

In the illustrated embodiment of FIGS. 1A to 2, the user support platform pivots freely up and down between zero and five degrees on each side about pivot axis 20. In the modified user support assembly of FIGS. 3 to 10, releasable locking mechanism 14 selectively secures user support platform 15 in the horizontal orientation of FIG. 2 if a user wishes to perform the exercise without core muscle involvement. When locking mechanism 14 is in the locked position of FIGS. 3 and 4, the user support platform 15 rotates only about the vertical axis 18 during a rotary torso exercise.

FIGS. 11 to 16 illustrate one embodiment of manually operable locking mechanism 14 between base 28 and user support 15 in more detail. However, it will be understood that different locking mechanisms may be used in alternative embodiments to releasably lock the user support to base 28. As illustrated in the exploded view of FIG. 11, the locking mechanism or device 14 basically comprises a first part or lock plate 110 having an opening 112 and a mounting portion 114, and a second part 135 including a lock pin housing 116 in which plunger or lock pin 118 is movably mounted. Housing 116 is mounted on mounting post 120 from which bumper plate 122 extends in a radial direction. Oppositely directed bumper pads 124 are secured to bumper plate 122. Switch lever body or sleeve 125 has a first end telescopically and rotatably engaged over the end of lock pin housing 116, as best illustrated in FIGS. 16A and 16B. A switch lever or manually operable lock release tab 126 is secured to rotatable sleeve 125. Plunger or lock pin 118 is secured to cam member 127 at the opposite end of switch lever body or sleeve 125, as best illustrated in FIGS. 16A and 16B, and extends from cam member 127 through a bore in housing 116. Return spring 129 urges lock pin 118 towards the locked position, as described in more detail below. A stop plate 128 secured to sleeve 125 engages one of the pads 124 in the unlocked position of FIGS. 4 and 10 and the oppositely directed pad 124 in the locked position of FIGS. 5, 6 and 15. In the illustrated embodiment, the first part or lock plate 110 is secured to the user support platform 15 while the support post 120 of the second part is secured to the user support base 28. However, in alternative embodiments, the first part or lock plate may be mounted on support base 28 and the second part may be secured to the user support platform 15.

Figure 12:
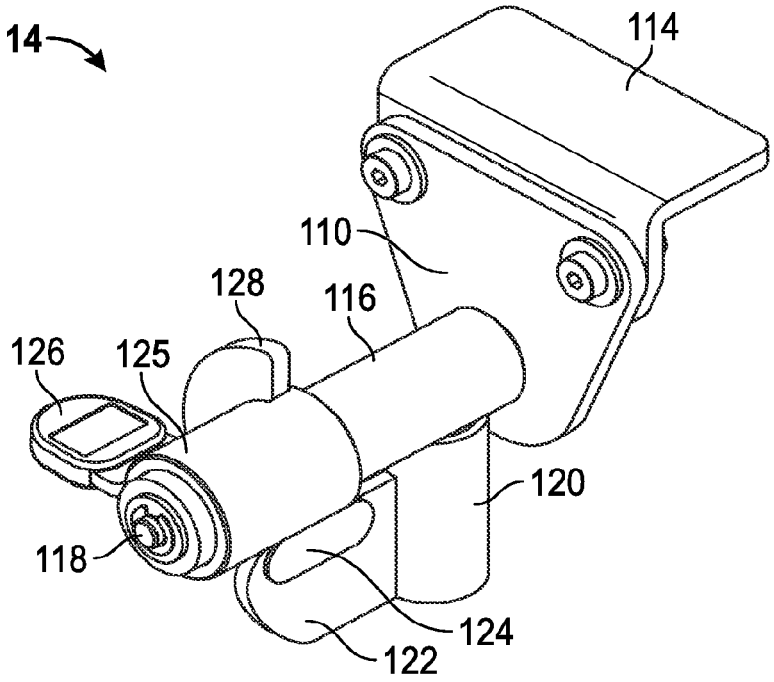
FIG. 12 is a perspective view of the assembled locking mechanism in the unlocked or lock released position.
Figure 13:
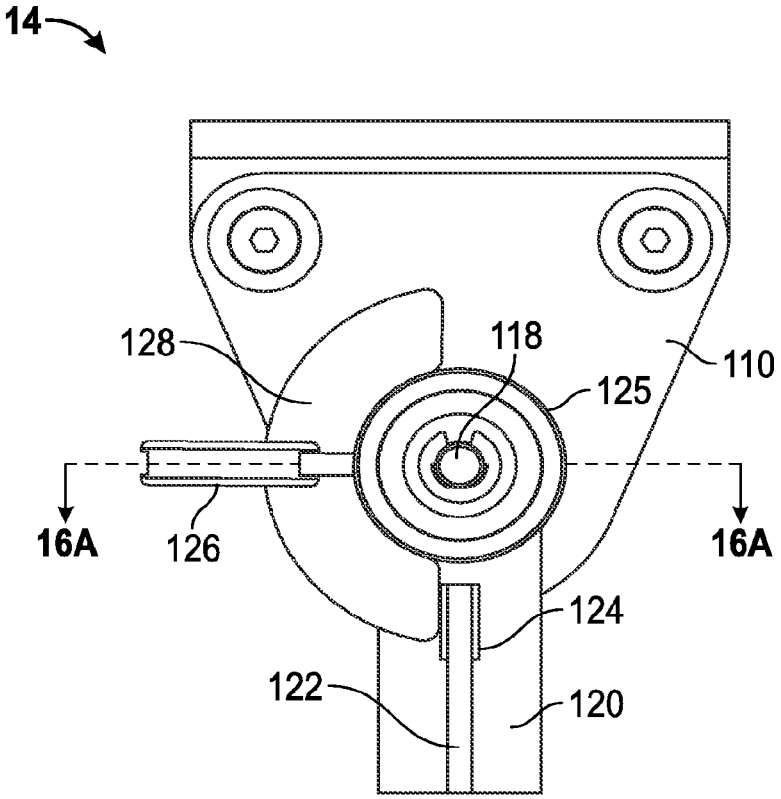
FIG. 13 is a front elevation view of the locking mechanism in the unlocked position.
Figure 14:
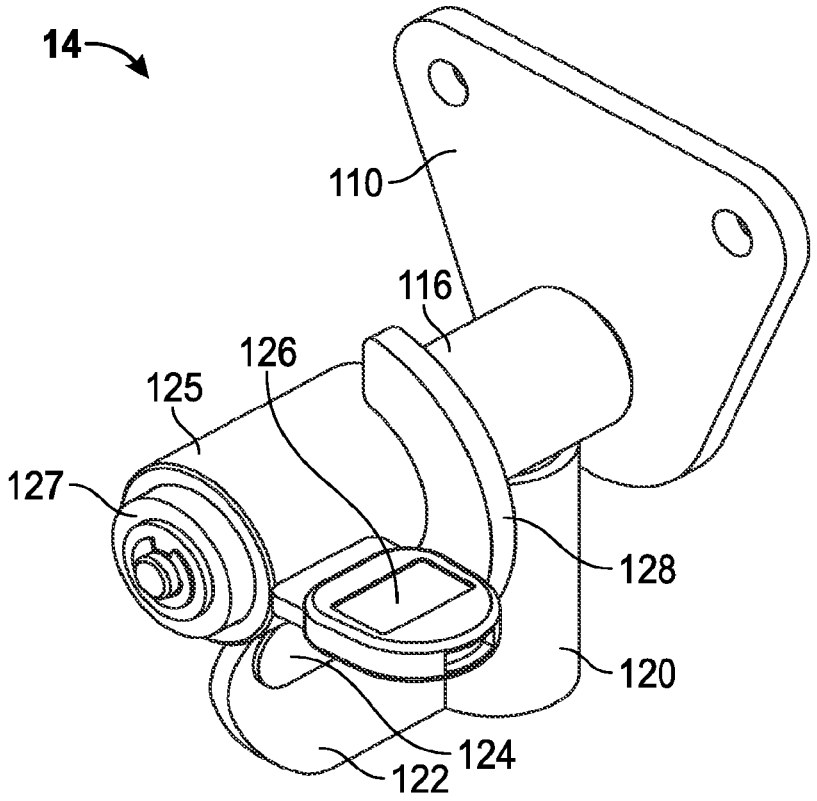
FIG. 14 is a perspective view of the locking mechanism similar to FIG. 12 but illustrating the locked position.
Figure 15:
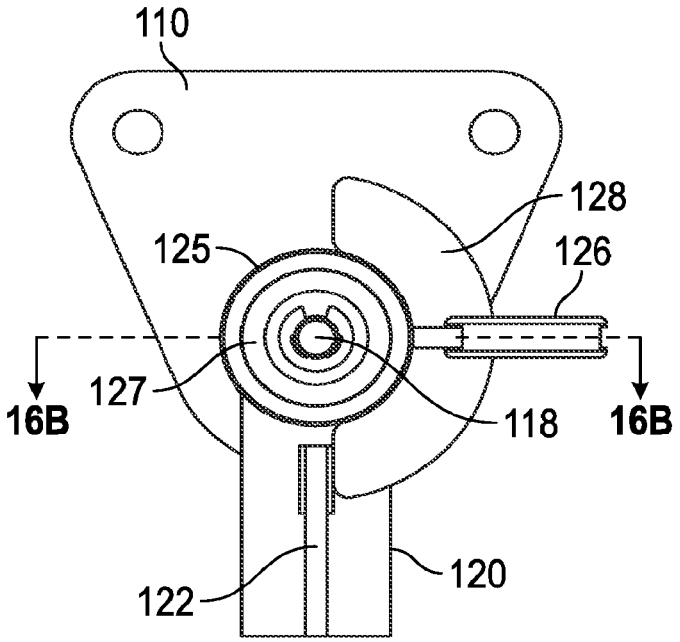
FIG. 15 is a front elevation view of the locking mechanism in the locked position of FIG. 14.
Figure 16B:
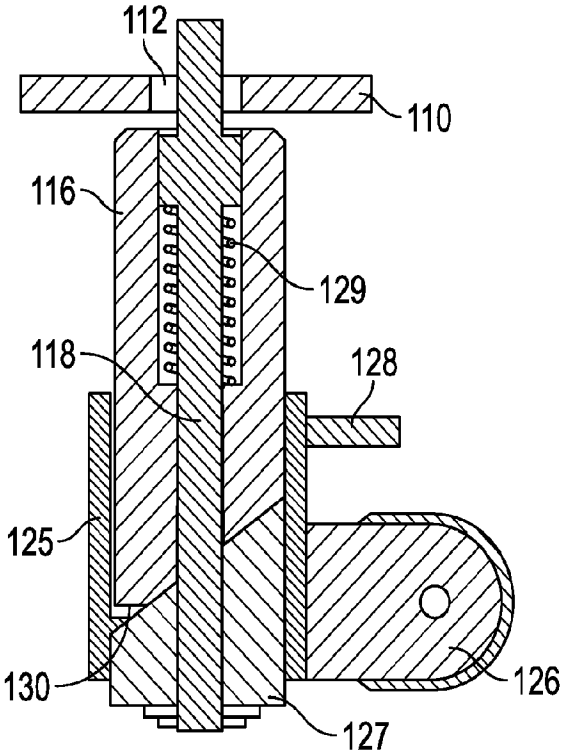
FIG. 16B is a cross-sectional view on the lines 16B-16B of FIG. 15 illustrating the locking mechanism in a locked position.
Figure 16A:
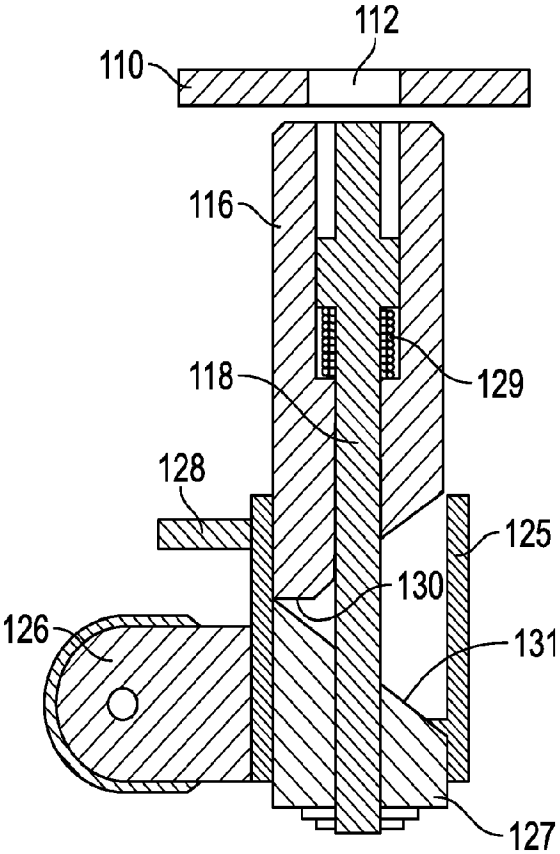
FIG. 16A is a cross-sectional view of the locking mechanism on the lines 16A-16A of FIG. 13.
Figure 17:
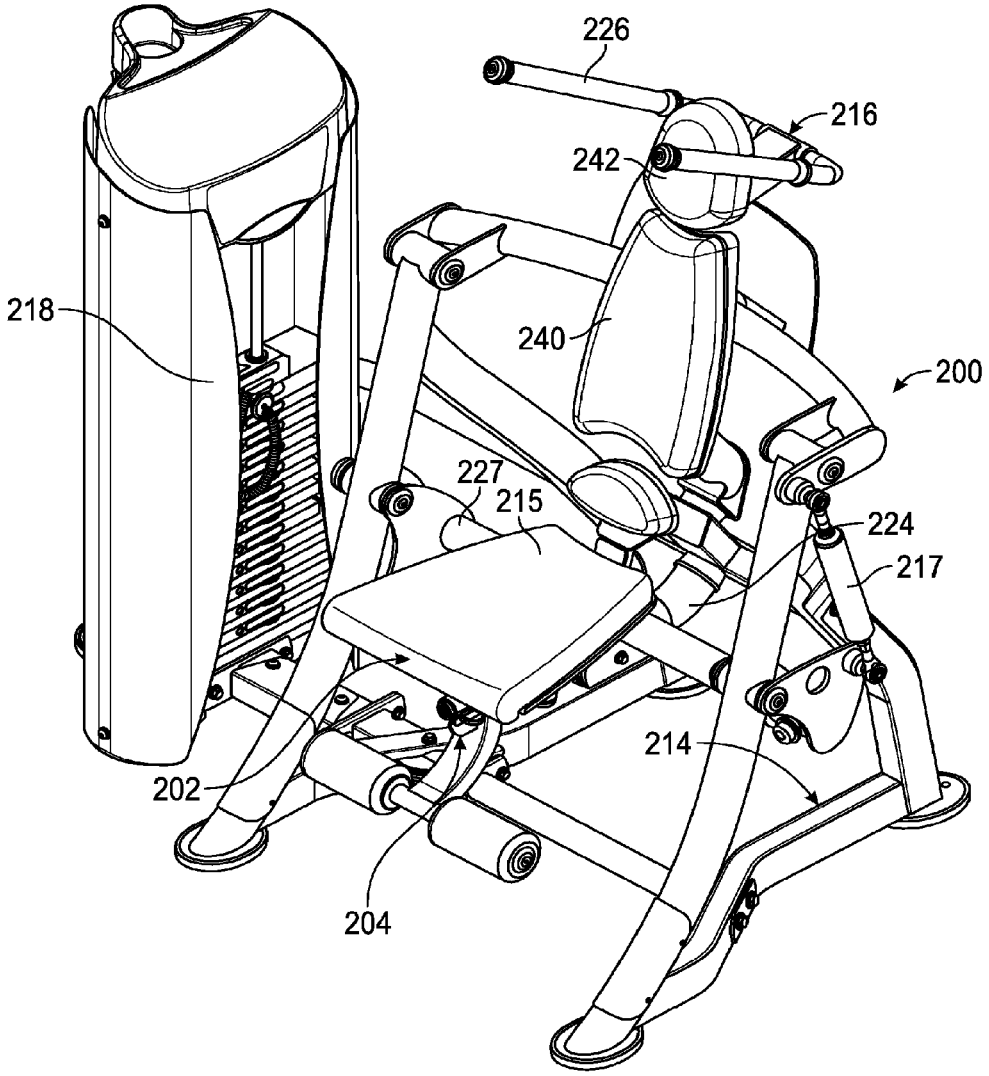
FIG. 17 is a front perspective view of an abdominal exercise machine according to a third embodiment having a two directional pivoting or rocking user support assembly and incorporating a manually operable locking mechanism similar to that of FIGS. 4 to 16.
Figure 18:
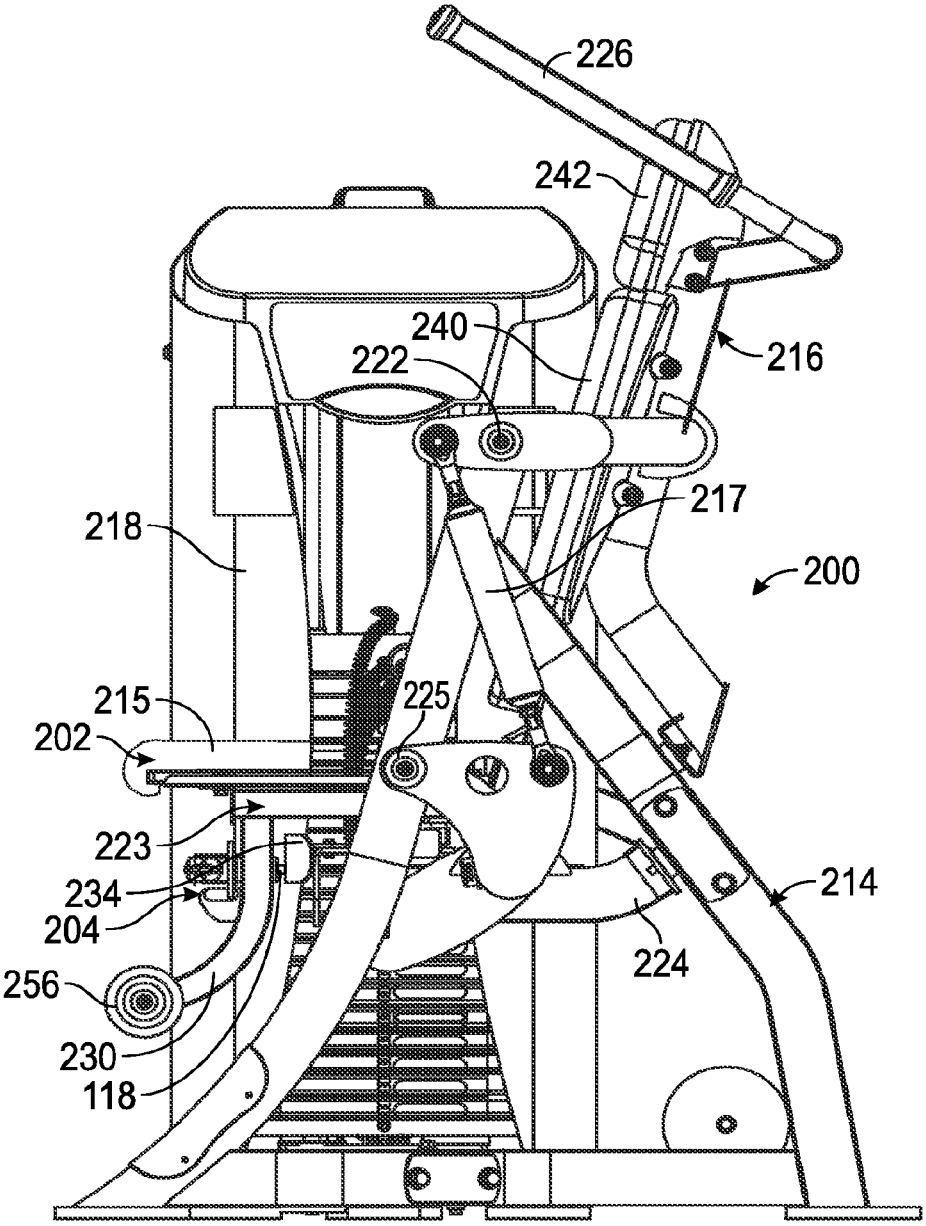
FIG. 18 is a side elevation view of the exercise machine of FIG. 17 with the locking mechanism in a locked position.
Figure 19:
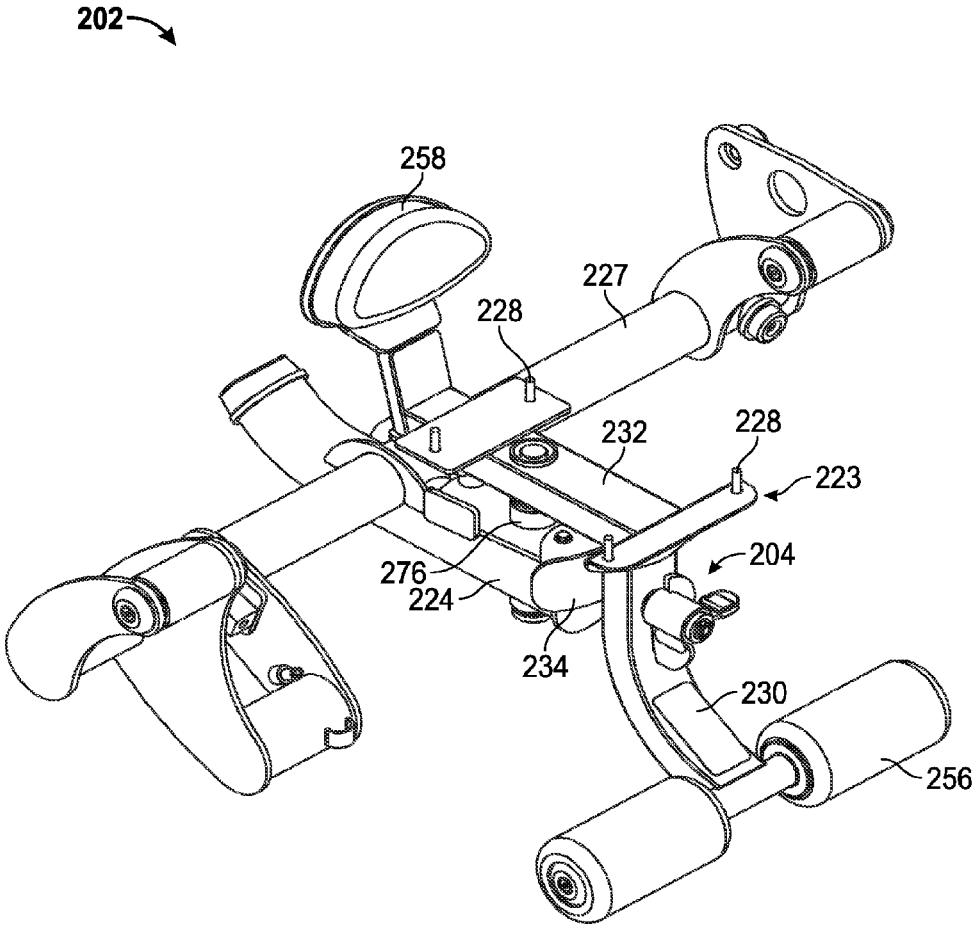
FIG. 19 is a front perspective view of the user support assembly of FIGS. 17 and 18 with the locking mechanism in the locked position and the seat pad removed to reveal details of the locking mechanism.
Figure 20:
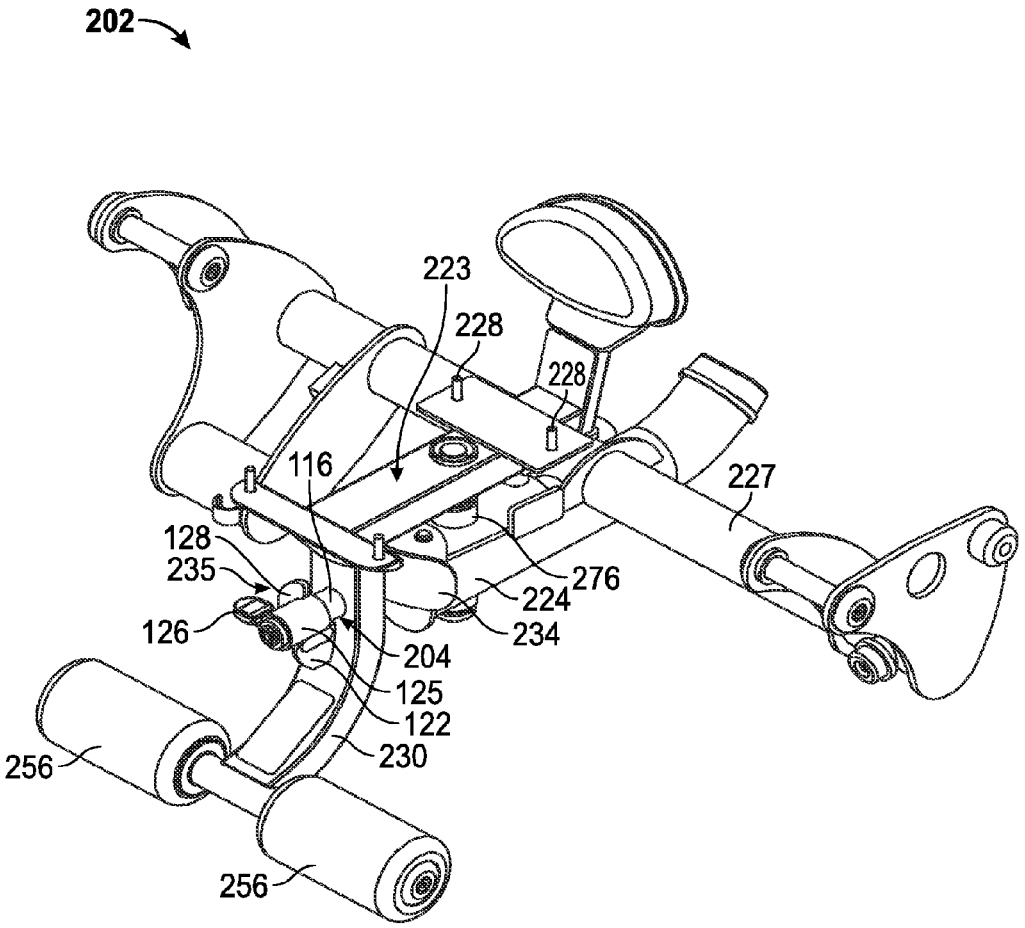
FIG. 20 is a front perspective view similar to FIG. 19 with the locking mechanism in the unlocked position.
Figure 21:
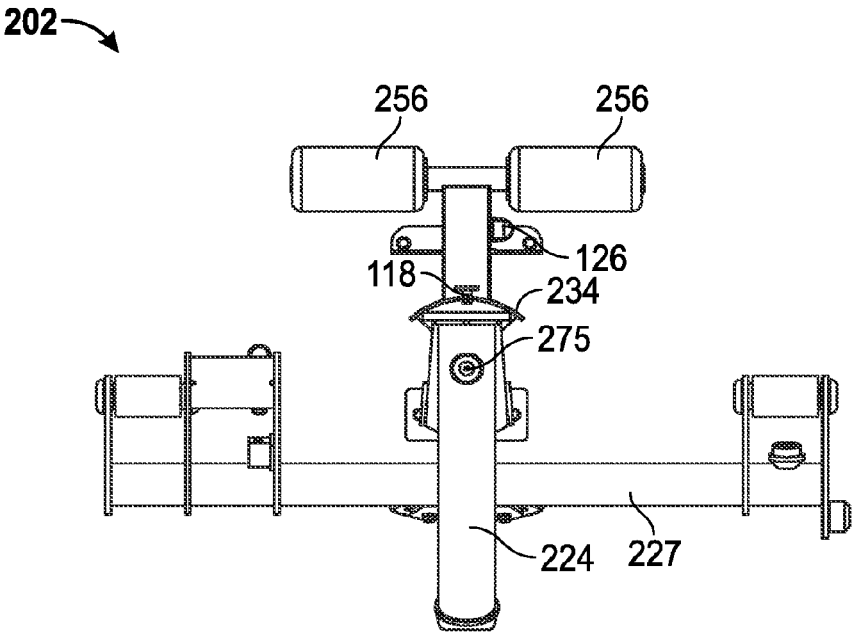
FIG. 21 is a bottom plan view of the user support assembly with the locking mechanism in the locked position of FIG. 19.

FIGS. 12, 13 and 16A illustrate the locking mechanism in the released or unlocked position, in which the lock pin is retracted into housing 118 and not engaged in opening 112. In this condition, user support 15 is unstable and can pivot or rock from side to side about axis 20 in addition to rotating about vertical pivot axis 19 during a rotary torso exercise. FIGS. 14, 15 and 16B illustrate the locking mechanism in the locked position in which lock pin 118 is advanced out of housing 116 and into opening 112, locking the user support to the base so that the user support is in a stable, horizontal orientation throughout the exercise. The user can choose whether to perform the exercise with the user support in the stable, locked condition or in an unlocked, unstable or rocking condition, depending on whether or not they wish to employ core muscles to maintain the user support in a horizontal position during the exercise. The user can readily flip lock release tab 126 back and forth between the unlocked and locked positions of FIGS. 16A and 16B.

Figure 3:
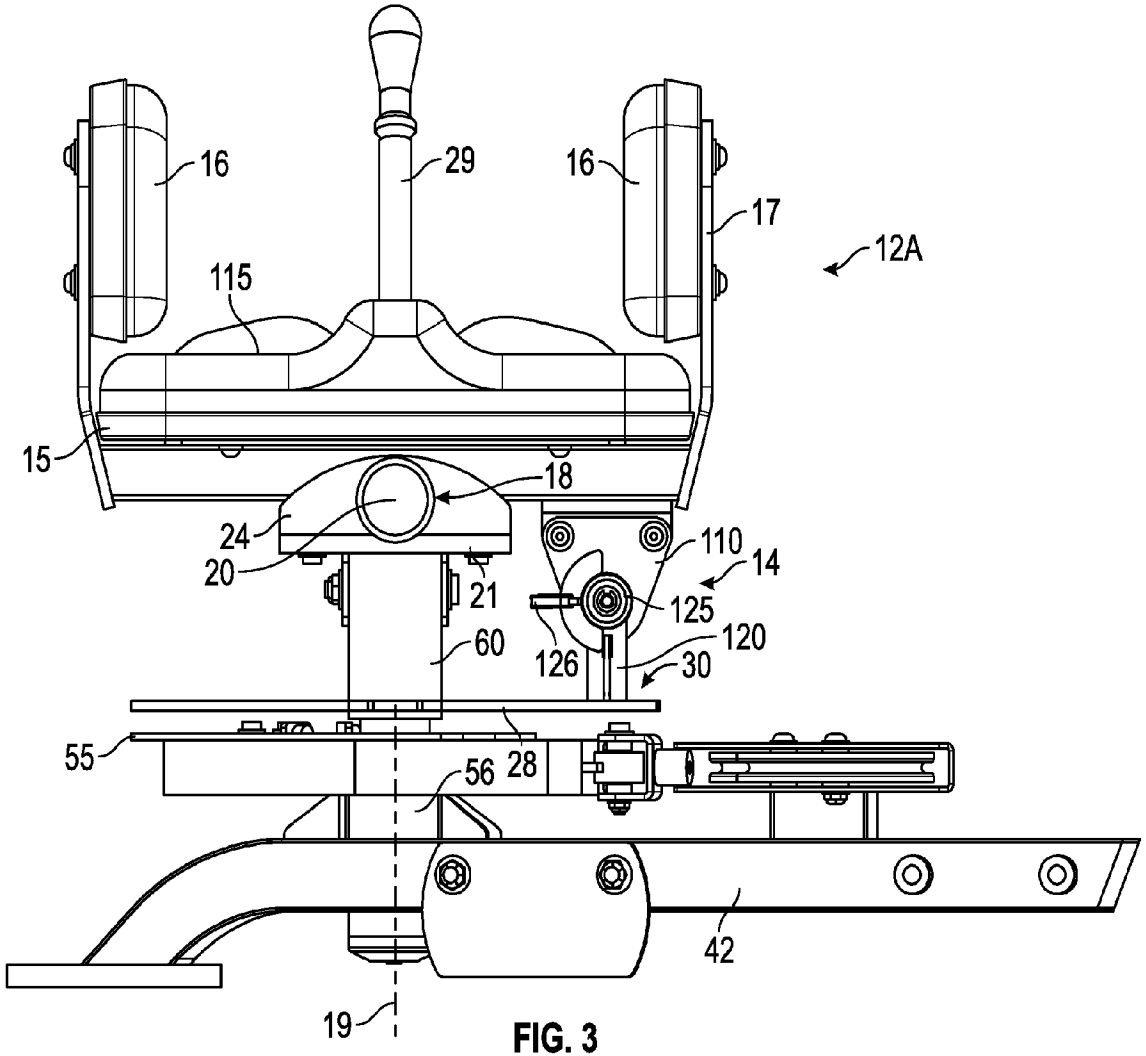
FIG. 3 is a front elevation view illustrating one embodiment of a modified user support assembly including a manually operable locking mechanism, which may be used in place of the user support assembly of FIG. 1A to 1C.
Figure 4:
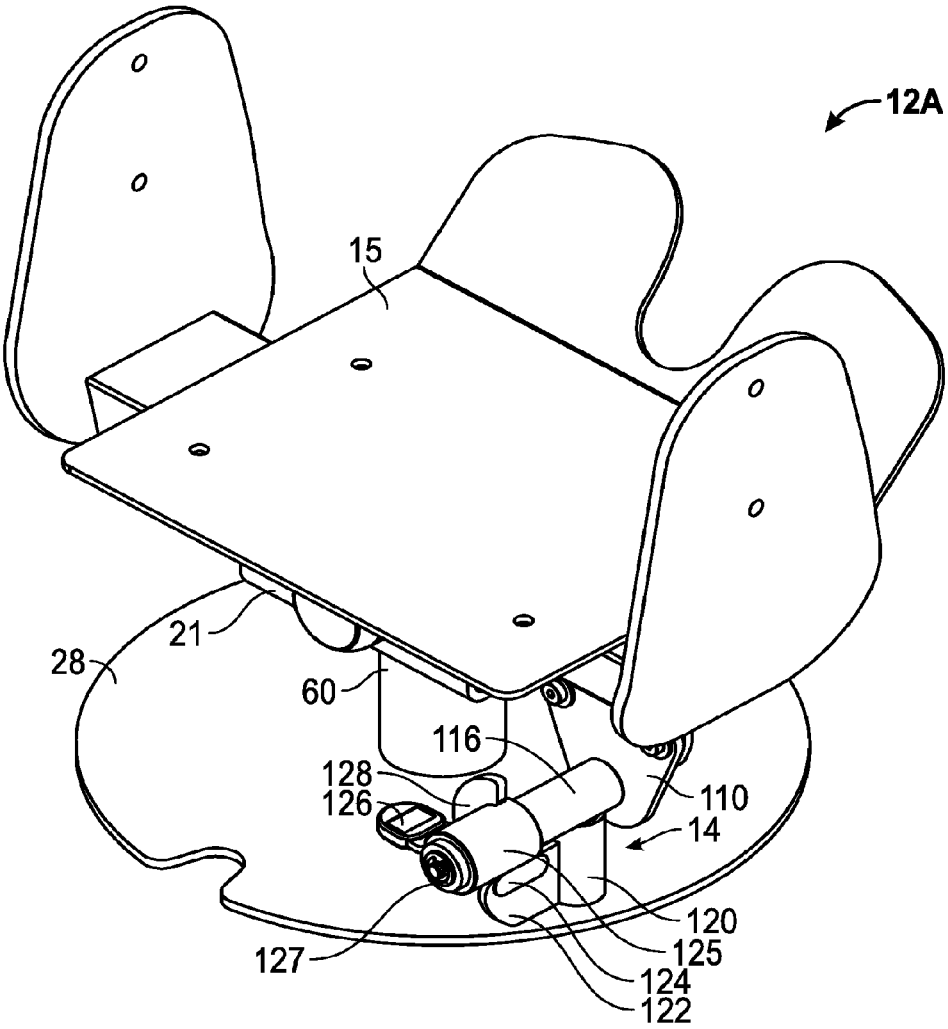
FIG. 4 is a perspective view of the modified user support assembly of FIG. 3, with the locking mechanism illustrated in the lock released position.
Figure 5:
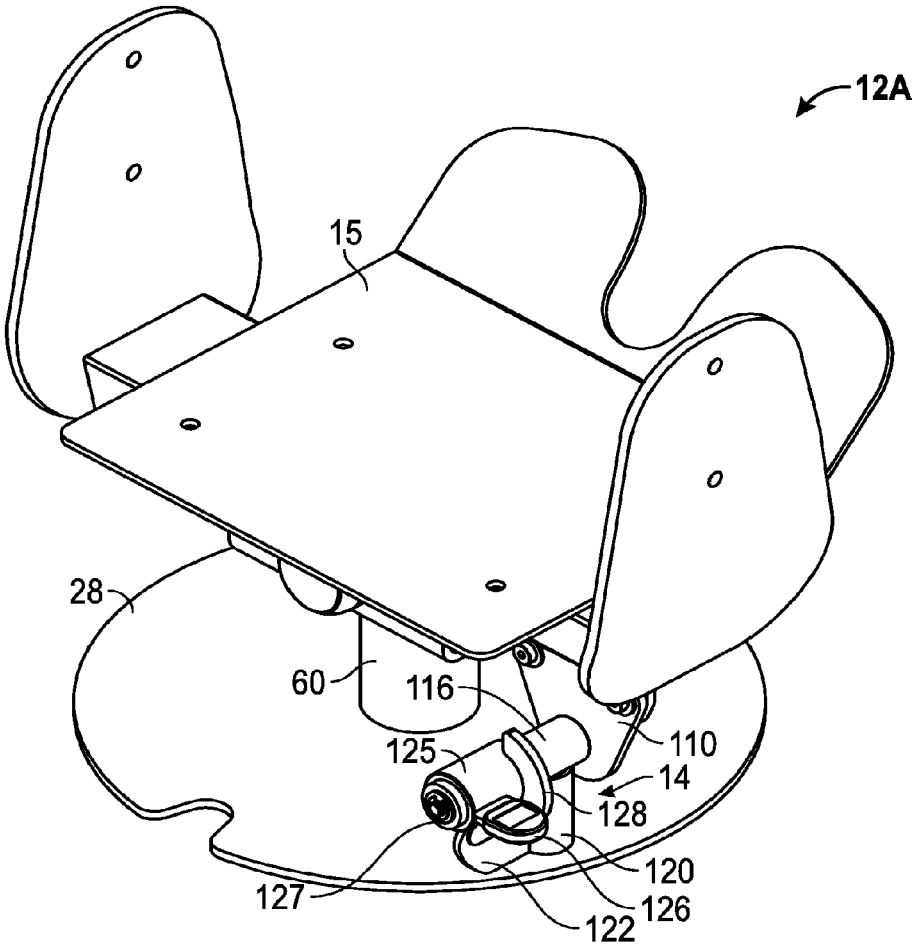
FIG. 5 is a perspective view of the user support assembly similar to FIG. 4 but with the locking mechanism in the locked position.
Figure 6:
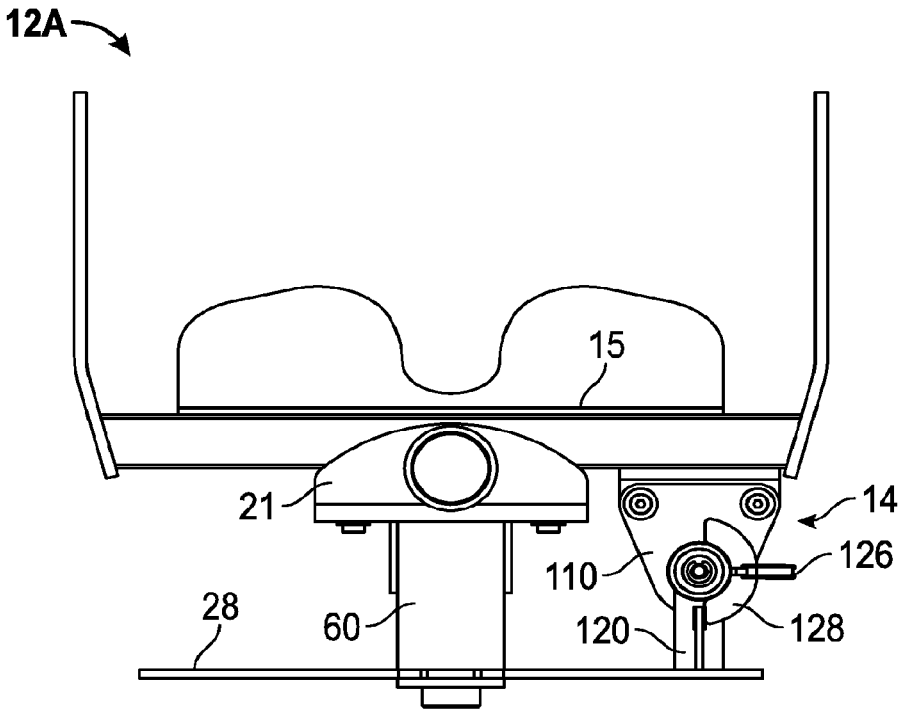
FIG. 6 is a front elevation view of the modified user support assembly of FIGS. 3 to 5 with the locking assembly or mechanism in the locked position.
Figure 7:
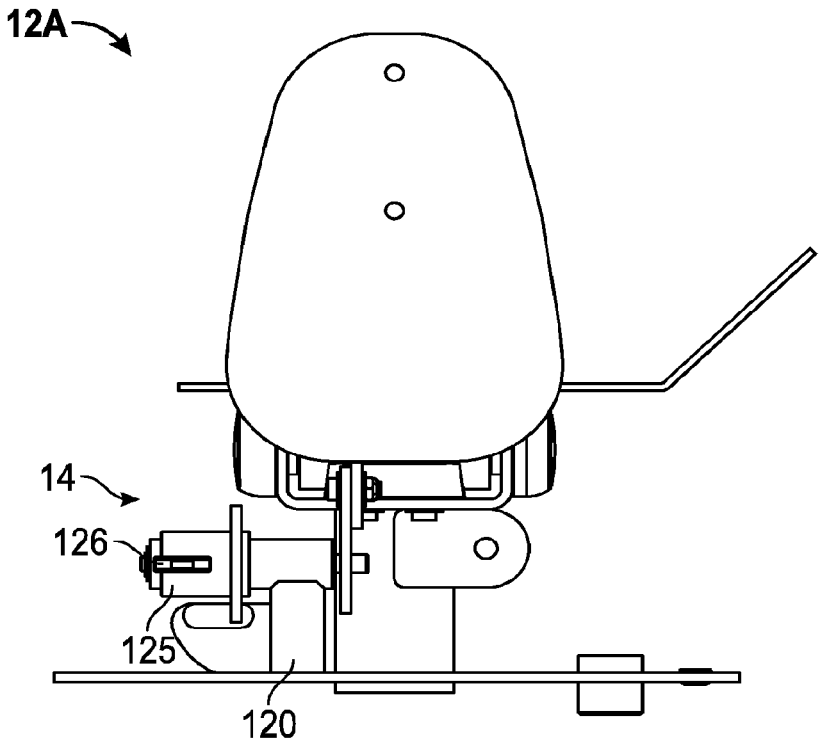
FIG. 7 is a side elevation view of the user support assembly in the locked position of FIG. 6.

When the user wishes to lock the device, they simply reach under the user support and rotate the lock control tab or switch lever 126 along with the attached switch lever body 125 from the first position illustrated in FIGS. 3, 12 and 13 into the second position illustrated in FIGS. 6, 14 and 15. As the switch lever body 125 and attached cam member 127 rotate from the position illustrated in FIG. 16A to the 180 degree rotated position of FIG. 16B, the rear edge 130 of the pin housing 116 which engages angled cam face 131 travels along the inclined face to the end position illustrated in FIG. 16B, and spring 129 extends to urge lock pin 118 and the attached cam member 127 and sleeve 125 into the extended position under the action of spring 129, so that pin 118 extends out of the housing and into locking engagement with lock plate opening 12. This locks the user support platform 15 to the rotatably mounted base 28 and prevents tilting of the platform about pivot axis 20. Rotation of the switch lever or tab 126 in the opposite direction rotates the cam plate back to the position of FIG. 16A, so that the fixed rear edge 130 of the pin housing forces cam member 127 and thus pin 118 back into the retracted position of FIG. 16A, again allowing the platform to rock back and forth about axis 20. This lock mechanism is very easy for the user to operate with their thumb or a finger, simply flipping lever or tab 126 back and forth between the locked and released positions, and the mechanism can be operated by a user when supported on the user support or prior to engaging the user support. Although a spring and cam mechanism is used for extending and retracting the lock pin in the embodiment of FIGS. 3 to 16, other pin or plunger extension and retraction mechanisms may be operated by rotating tab or lever 126 in alternative embodiments.

The exercise machine 10 incorporating the releasably lockable, two directional pivoting user support 12 (or 12A) in FIGS. 1A to 1C and 2 is a rotary torso machine in which the user rotates their lower torso between left and right swiveled positions relative to the upper torso, back into an aligned, front facing position relative to the upper torso. However, it will be understood that the user support device 12 or lockable user support device 12A may be used on other exercise machines for performing different exercises in other embodiments.

Rotary torso exercise machine 10 of FIGS. 1A to 1C basically comprises a main frame having a base strut 42 and a main upright 44, an upper torso stabilizing assembly 45 mounted at the upper end of main upright 44, and the unstable kneeling user support device 12 (or 12A) is mounted on rotational pivot assembly 30 supported on the base strut 42 of the main frame and configured for rotation of the user support device about vertical pivot axis 19 (see FIG. 1B). In this embodiment, exercise resistance is provided by a selectorized weight stack 48 located in weight stack housing 50 secured to the vertical upright 44 via cross bar 52 and to base strut 42 via cross member or guide tube 53. A selected amount of weight is secured to the rotating base 28 of the user support via one or more cables 54 extending around various guide pulleys in a conventional manner, as illustrated in FIG. 1A. Other types of exercise resistance may be provided in alternative embodiments.

User support base 28 is rotatably mounted on base plate 55 which is secured to base strut 42 via a pivot pin 56 at the center of plate 55 which is rotatably engaged in hollow mounting tube 60 which extends upwards from base plate 28. Rotational range adjustment lever 29 is pivotally secured to the mounting tube 60 and extends outwardly and upwardly at an angle from tube 60 so that it is conveniently located for gripping by a user kneeling on the platform in order to adjust the starting position for a rotary torso exercise. A user can adjust the user support device to a desired exercise starting position at an angle to the right or left of a forward facing position in alignment with the upper torso by gripping and pulling the handle and rotating the user support device to the desired position.

Figure 8:
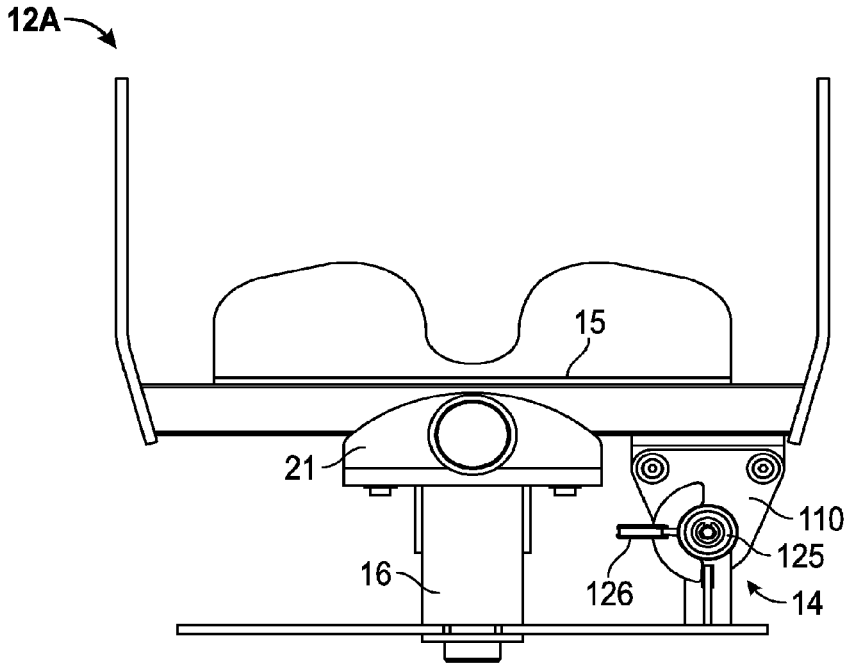
FIG. 8 is a front elevation view similar to FIG. 6 but with the locking assembly in the unlocked position.
Figure 9:
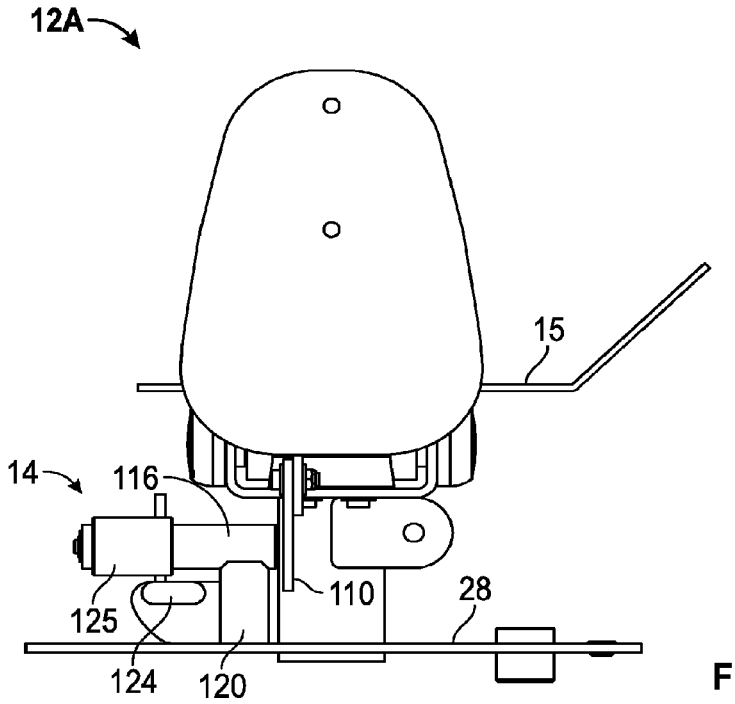
FIG. 9 is a side elevation view similar to FIG. 7, but with the locking assembly in the unlocked position.

The upper torso stabilizing assembly 45 is secured to main upright 44 via four bar pivot assembly 61 and comprises a pair of stabilizing handles 62 and a pair of upper torso stabilizing pads 64 for engaging the user's chest. Handles 62 and pads 64 are mounted on a support post 71 secured to the forward end of the upper pair of bars of the four bar pivot assembly 61 via mounting bar 63. A range of motion (ROM) device 65 between the upper and lower bars of the four bar pivot assembly allows user adjustment of the height of chest pads 64 and handles 62 so that the pads are at chest level. Device 65 comprises ROM plate 67 also secured to support post 71 and having a series of openings 69. Range of adjustment knob 66 is mounted on a forward end of one of the lower bars of the pivot assembly, as illustrated in FIG. 8, and extends into an aligned opening in ROM plate 67. Range adjustment knob 66 is released from the ROM plate 67 by a user to allow the height of the pads to be adjusted, and is then released to engage in the appropriate opening when the pads are at the desired chest level height. Gas springs 73 extend between the upper and lower bar of the four bar pivot assembly on each side of the assembly.

FIG. 1A illustrates a first start position for a rotary torso exercise in which the user support device 12 is rotated to the left of a central position aligned with the upper torso stabilizing assembly 45. FIG. 1B illustrates a user 70 kneeling on user support pad 15 with the user support in the position of FIG. 1A, with their upper torso rotated to the right to engage the chest support pads 64 while they grip handles 62. The central position is illustrated in FIG. 1C. In the central position, the user support device 10 faces the main upright and the lower torso of a user kneeling on the support pad 15 is aligned with the upper torso. In an alternative or second start position for a rotary torso exercise, the user support device 10 is rotated to the right of the central position, i.e. facing in the opposite direction to FIGS. 1A and 1B, and the user rotates their upper body to the left to engage the upper torso support. The start position may be adjusted by the user by gripping the handle of adjustment lever 29, pulling it towards their body so as to lift a pin 72 out of one of two slots 74 on opposite sides of the lower fixed plate or base plate 55 of pivot assembly 30, then rotating the user support device into the desired adjusted position and releasing the lever 29 so that the pin 72 drops back into aligned slot 74. The angular length of slots 74 controls the amount of rotation of the lower torso relative to the upper torso.

In order to perform the exercise, the user 70 first adjusts the kneeling user support device 10 to the desired starting position, i.e. degrees of exercise range to rotate lower torso to face forward alignment with upper torso. Exercise is performed in one direction, starting either from the position of FIGS. 1A and 1B, or the oppositely directed position. Once the user support device 12 or 12A is in the desired start position, user 70 assumes a kneeling upright position on the kneeling platform, as illustrated in FIG. 1B for the starting position of FIG. 1A. Note that the kneeling platform rocks side to side about axis 20 during this positioning, unless locked against this rocking movement by locking mechanism 14 where user support assembly 12A replaces assembly 12 of FIGS. 1A to 2. The side to side rocking requires balancing using core muscles to keep the user support platform level and thus adds difficulty to the exercise.

The upper torso stabilizing pads/handles assembly 45 is then adjusted so the pads 64 are at chest level, using ROM device 65. Once the pads are locked in position, the user grasps the handles and pulls their chest tight to pads for stabilization, as illustrated in FIG. 1B. Alternatively, the exercise may be performed using handles 62 only to stabilize the upper torso, keeping the chest off the pads 64 during the exercise. This provides an added level of core engagement.

Once the user is properly positioned on the kneeling platform or user support device 12 or 12A, while gripping handles 62 and optionally engaging the chest pads of the upper torso support assembly 45, the user's lower torso is in a rotated away position from the upper torso. In the start position of FIG. 1B, the lower torso is rotated to the left relative to the upper torso. In order to perform the exercise, the user rotates their lower torso and the user support platform 15 on which they are kneeling to the right, into alignment with the stabilized face forward position of the upper torso, using a slow controlled movement, and ending up in the end position of FIG. 1C. During this movement, the user exercises core muscles in order to keep the kneeling platform 15 of unstable user support device 10 balanced during the movement. Alternatively, when the user support assembly 12A of FIG. 3 with the releasable locking mechanism 14 replaces user support 12, the user can choose to perform an easier exercise with the user support platform locked in the horizontal or substantially horizontal orientation, by moving the locking pin into the locked position, as described above. When the user's body is in the central position of FIG. 1C, the lower torso and user support device are rotated back to the starting position of FIG. 1B and the exercise is repeated for the desired number of repetitions. The platform is then readjusted to the opposite starting position, the user 70 kneels back on the kneeling pad 15, and again grips the handles 42 and pulls the chest pads 64 in to their chest. In this start position, the lower torso is rotated to the right of the upper torso. They then rotate their lower body on the user support device 20 or 20A to the left, back into the forward facing or central end position of FIG. 1C, and the exercise is repeated for the desired number of repetitions. Load bearing cable 54 linked to the selected number of weights in weight stack 48 provides the desired amount of resistance to rotation of the user support device between either start position and the end position.

The user support device or assembly 12 or 12A is designed to provide a level of instability for the purpose of greater challenging the core muscles to balance the platform while performing the exercise motion. The kneeling platform instability may be provided in any or all planes to aid in engaging the core muscles. The unstable plane selection for the user support device of FIGS. 1 to 10 is left to right or side to side. The degree of instability is approximately 5 degrees off horizontal, left or right. The rubber bumper pads 26 contact the undersurface of the platform when tilted through five degrees to the left or right, limiting the amount of instability. Different degrees of instability may be provided in alternative embodiments by bumper pads of different heights, for example the platform may be tiltable through an angle in the range of about 3 to 10 degrees off horizontal. The more weight stack resistance selected, the greater degree of aided core muscle engagement necessary to keep the kneeling platform balanced. For an added level of core engagement, the handles alone may be used to stabilize the upper torso while keeping the chest off the pads during the exercise motion. By incorporating modified user support assembly 12A into machine 10 in place of user support assembly 12, the user is able to select whether or not to use core muscles to keep the platform 15 balanced during the exercise, simply by rotating switch lever or lock release tab between the unlocked and locked positions of FIGS. 4 and 5.

The releasably lockable, unstable user support device 12A in the previous embodiment is designed to support a user in an upright kneeling position. In alternative embodiments, the unstable user support device may be designed to support users in different positions, such as seated positions. FIGS. 17 to 22 illustrated an abdominal exercise machine 200 incorporating a second embodiment of an unstable user support device 202 which is designed for supporting a seated user, and includes a manually releasable locking mechanism 204 for releasably locking the user support against rotation about one pivot axis. Device 202 may be used to replace a stable user support seat on an abdominal exercise machine designed for supporting a seated user.

Some other examples of exercise machines on which unstable seated user support device 80 may be used are upper body exercise machines such as biceps curl exercise machines, seated mid row exercise machines, pee fly exercise machines, and chest press and shoulder press exercise machines. Some examples of such exercise machines on which unstable user support device 80 may be used are the RS-1102 biceps curl exercise machine, the RS-1203 seated mid row exercise machine, the RS-1302 pee fly exercise machine, the RPL-5301 chest press exercise machine, and the RS-1501 and RPL-5501 shoulder press exercise machines which all have rocking seats and are manufactured by Hoist Fitness Systems, Inc. of San Diego, Calif., or any of the rocking user support exercise machines described in U.S. Pat. Nos. 7,717,832, 7,760,269, 7,766,802, 7,794,371, 7,901,337, 7,938,760, 7,976,440, 7,981,010, 7,993,251, and 8,002,679 of Hoist Fitness Systems, Inc. The unstable user support device 202 with releasable locking mechanism 204 may also be used on other types of exercise machines with rocking user supports in alternative embodiments.

The abdominal exercise machine 200 of FIGS. 17 to 22 is similar to the abdominal exercise machine described in U.S. Pat. No. 8,172,732 of Webber et al. ('732 patent), and has a swiveling seat as described in U.S. Pat. No. 7,867,149 of Webber et al. ('149 patent), and the contents of each of the aforementioned patents are incorporated herein by reference. In the machine 200 of this embodiment, the releasable locking mechanism of the '732 and '149 patents is replaced with locking mechanism 204 which is similar to locking mechanism 14 described above in connection with FIGS. 3 to 16, as described in more detail below. In one embodiment, machine 200 has a main frame 214 on which the user support assembly 202 is pivotally supported at a location spaced above the ground. The user support assembly includes a user support pad or platform 215 which is pivoted for movement about two different pivot axes, as explained in more detail below. A pivoted exercise arm assembly 216 is linked to the user support assembly 202 by a connecting link 217 to control movement about one of the pivot axes, and is also linked to a selected number of weights in weight stack 218 to provide exercise resistance.

The exercise arm assembly 216 is pivoted to an upper part of the main frame 214 for rotation about a first horizontal pivot axis 222, while the user support assembly 202 is pivoted to the frame at a location spaced below the first pivot axis for pivotal motion about a second horizontal pivot axis 225 parallel to the first pivot axis. A user seated on the user support pad 215 pulls down on handles 226 to perform an abdominal exercise, so that the exercise arm assembly pivots downward about axis 222 while the user support assembly pivots upward about axis 225.

Figure 22:
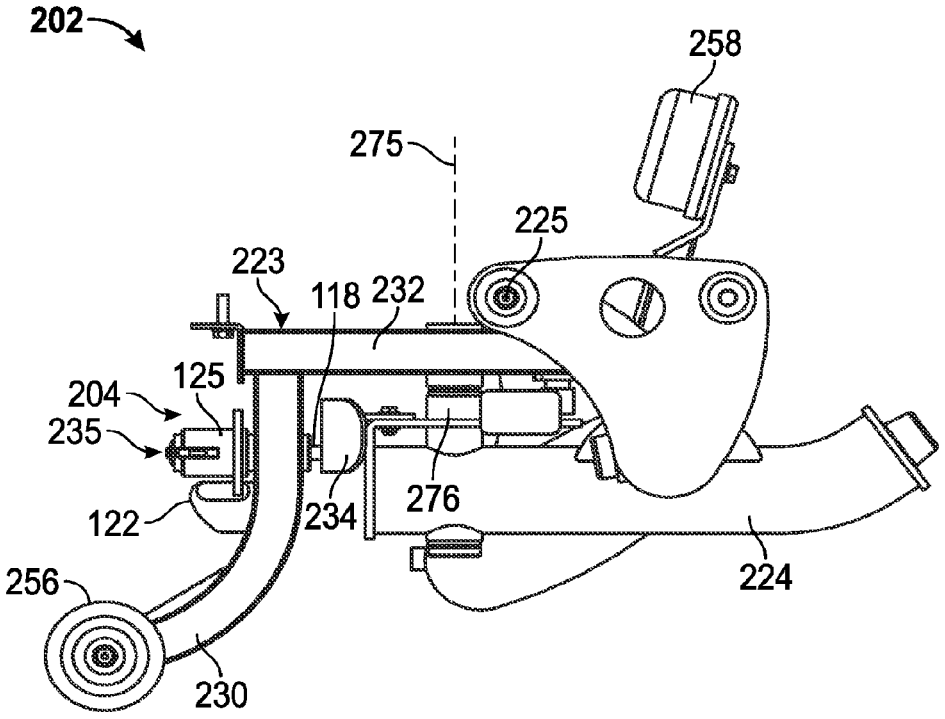
FIG. 22 is a side elevation view of the user support assembly with the locking mechanism in the locked position of FIGS. 19 and 21.

The user support assembly 202 is illustrated in more detail in FIGS. 19 to 22 with the user support pad or platform 215 removed to reveal details of the releasable lock mechanism 204. Assembly 202 includes base having a base strut 224 which is pivoted to the main frame for rotation about pivot axis 225 via cross bar 227. User support platform 215 is rigidly mounted on user support frame 223, which in turn is pivotally mounted on the base or strut 224 for swiveling about a pivot axis 275 extending transverse to user support platform 215 via pivot pin extending into pivot sleeve 276 on the upper surface of base strut 224, as best illustrated in FIG. 22. A mounting plate beneath user support pad 215 is secured to the base frame via fasteners 228. A stabilizing support 256 for engagement by the user's lower legs is provided at the end of strut 230 which extends downward from a forward end of member 232 of frame 223 on which the pad 215 is supported. Stabilizing support 256 comprises a pair of roller pads designed to engage over the feet of a user when seated on the support assembly. In alternative embodiments, the stabilizing support may alternatively comprise one or more foot plates on which the user's feet rest, or one or more knee or leg pads designed to engage in front of the user's knees or shins.

In the embodiment of FIGS. 17 to 22, manually releasable locking mechanism 204 replaces the locking device described in U.S. Pat. No. 7,867,149 and is easier to use. Mechanism 204 is similar to locking mechanism 14 of the previous embodiment, and like reference numbers are used for like parts as appropriate. In this embodiment, the first part or locking plate 234 is mounted at the forward end of pivoting base strut 224 rather than depending from user support 215 which is engaged by the user, and second part 235 which includes retractable lock pin 118 is mounted on the downwardly depending strut 230 of the user support frame 223. As in the previous embodiment, rotation of the manually engagable tab or switch lever 126 between the unlocked position illustrated in FIG. 20 and the locked position illustrated in FIG. 19 moves lock pin 118 between a retracted position in which it does not engage the opening in locking plate 234 and an extended position in which pin 118 engages the aligned opening (see FIGS. 18 and 22) to lock the user support or seat against rotation about vertical axis 275. The lock actuating mechanism in this embodiment is identical to the mechanism illustrated in FIGS. 16A and 16B and described above, and is therefore not described in detail. Because entering and exiting a free swiveling seat can be awkward, the locking mechanism may be used to temporarily secure the seat in a centered, forward facing orientation, and then retracted to allow free swiveling of the seat during an exercise. Alternatively, if the user wishes to perform the abdominal exercise in a stable position without engaging core muscles, the seat may remain locked in position throughout an exercise.

To perform an exercise, a user sits on the seat pad with their buttock up against tail bone pad or secondary support 258 which is supported on the rear end of base strut 232, knees bent over the front edge of the seat pad and their feet hooked behind the stabilizing roller pads 256. The user then unlocks the user support frame 223 from the base strut 224 by reaching down in front of the seat and rotating locking tab or switch lever 126 from the position illustrated in FIG. 19 to the position illustrated in FIG. 20, if they wish to perform the exercise on a free swiveling seat. Next, the user leans back against user engaging back and head pads 240, 242 on the exercise arm 216, grabs the user engaging handles 226 and pulls the handles forward in a downward motion. This action pulls the user engaging pads into contact with the user's head, upper back and shoulders, pushing them forward and downward and causing the user's upper body to bend just below the rib cage and activate the upper abdominal muscles. At the same time, the connecting link 217 attached to the exercise arm is pushed down by pivotal movement of exercise arm 216 in an anti-clockwise direction about pivot axis 222, simultaneously pushing the lower pivoting cross strut 227 of the user support assembly to pivot downwardly in a clockwise direction about pivot axis 225. This simultaneously pivots the rear end of base support or strut 224 downwards and lifts the forward end of strut 224 upward in a rearward direction, simultaneously tilting the user support upward and rearward. This movement lifts the user's knees while it lowers the user's hips, causing the user to bend forward at the waist, activating the lower abdominal muscles. The combined movement of upper and lower body produces a compound movement abdominal exercise.

Swiveling, side-to-side movement of the user support about pivot axis 275 is supplied by the pivotal connection to the base support or base strut 224 via a pivot axle which engages in pivot sleeve 276 as seen in FIG. 22. This is an unrestricted, free-swiveling movement that is controlled by the user. It allows the user to pivot the seat from side to side as the user support movement arm 52 is pivoted by actuation of the exercise arm assembly, involving a greater number of torso muscles. Swiveling the knees to one side or the other involves the oblique muscles as well as the upper and lower abdominal muscles. Just trying to prevent the seat from swiveling and keeping it centered during the exercise movement requires core stabilizing muscles in the abdominal and low back area to become involved. The end result is a movement pattern that provides simultaneous vertical and horizontal seat movement that involves multiple muscle groups and requires multiple joint actions. If the user wishes to perform a simple abdominal exercise without engaging the core stabilizing muscles, they can easily reach down in a centered position and rotate locking tab or switch control lever 126 back from the released or unlocked position of FIG. 20 to the locked position of FIG. 19.

The unstable user support devices described above allow for tilting or rocking of a user support platform from side to side through a limited angle of rotation about a pivot axis parallel to the support platform, or rotation of a user support seat from side to side about a pivot axis extending transverse to the seat, so as to involve core muscles to stabilize the support platform while performing various types of exercises, including exercises performed in kneeling and seated positions. Although the rocking or rotation in the described embodiments is about a single pivot axis different from the main user support pivot axis or rocking axis, tilting about different axes may be provided in alternative embodiments, including an alternative embodiment with a universal or multi-directional pivot connection between the mounting bracket or base and the user support platform. The instability of the user support platform may therefore be provided in multiple directions or planes, and through any desired angular range. The instability of the user support platform challenges the core muscles in balancing the platform while performing the exercise, providing enhanced exercise and training. At the same time, the manually releasable locking mechanism provided in the above embodiments allows a user to switch easily back and forth between an unstable or freely swiveling user support, and a locked user support which rotates only about a single or main rocking axis.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

We claim:

1. An exercise machine, comprising:

a stationary main frame;

a user support assembly mounted on the main frame;

the user support assembly comprising a base pivotally mounted on the main frame for rotation about a vertical pivot axis, a user support adapted to support a user in an exercise position during an exercise, and a pivot connection between the user support and the base configured for allowing free rotation of the user support about at least one horizontal pivot axis in at least two opposite directions from an upright centered user support position;

an exercise arm assembly movably mounted relative to the main frame and having a user engaging portion which adapted for engagement by a part of a user's body to perform an exercise when a user is supported in an exercise position on the user support; and a locking device between the user support and the base which is configured to selectively lock the user support against rotation about the horizontal pivot axis, the locking device having a first, locking position defining a stable support mode in which the user support is locked against rotation about the horizontal pivot axis during an exercise, and a second, released position defining an unstable support mode in which the user support is free to rotate about said horizontal pivot axis during an exercise.

2. The exercise machine of claim 1, further comprising a stop assembly between the base and user support which defines respective first and second end positions and limits rotation of the user support in the unstable support mode in each direction from said centered user support position to a predetermined angular range.

3. The exercise machine of claim 1, wherein the stop assembly comprises first and second end stops defining the respective first and second end positions.

4. The exercise machine of claim 1, wherein the vertical pivot axis is perpendicular to the horizontal pivot axis.

5. The exercise machine of claim 1, further comprising a connecting linkage between the user support assembly and exercise arm assembly which links movement of the exercise arm assembly during an exercise to movement of the user support assembly about said vertical pivot axis, and a load which resists movement of at least one of the user support assembly, the exercise arm assembly and the connecting linkage.

6. The exercise machine of claim 1, wherein the user support includes a user support platform and the horizontal pivot axis is a tilting pivot axis in a plane parallel to the user support platform.

7. The exercise machine of claim 3, wherein the end stops comprise resilient bumpers mounted on one of the base and the user support platform on opposite sides of the horizontal pivot axis.

8. The exercise machine of claim 7, wherein the end stops are resilient bumpers mounted on the base.

9. A movable user support assembly for supporting a user in a seated or kneeling position while performing an exercise on an exercise machine, comprising:

a base;

a two directional pivoting user support associated with the base and configured to support a user in an exercise position while performing an exercise, the user support being rotatable about a first pivot axis during the exercise;

a pivotal connection between the base and the user support defining at least one second pivot axis for free rotational movement of the user support about said at least one second pivot axis in at least two opposite directions between first and second end positions, the user support having a centered support position between said end positions; and a locking device which is configured to selectively lock the user support against rotation about the second pivot axis, the locking device having a first, locking position defining a stable support mode in which the user support rotates about the first pivot axis only and is locked against rotation about the second pivot axis, and a second, released position defining an unstable support mode in which the user support is free to rotate about said second pivot axis between said end positions, wherein the pivotal connection defines at least two non-vertical pivot axes.

10. A movable user support assembly for supporting a user in a seated or kneeling position while performing an exercise on an exercise machine, comprising:

a base;

a two directional pivoting user support associated with the base and configured to support a user in an exercise position while performing an exercise, the user support being rotatable about a first pivot axis during the exercise;

a pivotal connection between the base and the user support defining at least one second pivot axis for free rotational movement of the user support about said at least one second pivot axis in at least two opposite directions between first and second end positions, the user support having a centered support position between said end positions; and a locking device which is configured to selectively lock the user support against rotation about the second pivot axis, the locking device having a first, locking position defining a stable support mode in which the user support rotates about the first pivot axis only and is locked against rotation about the second pivot axis, and a second, released position defining an unstable support mode in which the user support is free to rotate about said second pivot axis between said end positions, wherein the pivotal connection is a universal joint configured for tilting of the user support platform in multiple directions from the centered support position.

11. A movable user support assembly for supporting a user in a seated or kneeling position while performing an exercise on an exercise machine, comprising:

a base;

a two directional pivoting user support associated with the base and configured to support a user in an exercise position while performing an exercise, the user support being rotatable about a vertical pivot axis during the exercise;

a pivotal connection between the base and the user support defining a horizontal pivot axis for free rotational movement of the user support about said horizontal pivot axis in at least two opposite directions between first and second end positions, the user support having an upright centered support position between said end positions; and a locking device which is configured to selectively lock the user support against rotation about the horizontal pivot axis, the locking device having a first, locking position defining a stable support mode in which the user support rotates about the vertical pivot axis only and is locked against rotation about the horizontal pivot axis, and a second, released position defining an unstable support mode in which the user support is free to rotate about said horizontal pivot axis between said end positions, wherein the locking device comprises:

a locking pin, a locking plate connected to the user support, and a rotatable lever, wherein movement of the rotatable lever extends the locking pin into an opening in the locking plate to place the user support into the stable support mode, and wherein movement of the rotatable lever retracts the locking pin out of the opening in the locking plate to place the user support into the unstable support mode.

12. The user support assembly of claim 11, wherein the user support includes a platform and a user support pad for engagement by a user mounted on the platform, and the horizontal pivot axis is parallel to the user support platform, whereby said user support platform is configured for free tilting movement in opposite directions about said horizontal pivot axis in the unstable support mode.

13. The user support assembly of claim 12, further comprising a stop assembly between the base and user support platform which defines respective first and second end positions and limits tilting movement of the user support platform from said centered support position in each direction to a predetermined angular range, the stop assembly comprising first and second end stops which engage the user support platform at respective opposite ends of the predetermined angular range to define the respective first and second end positions.

14. The user support assembly of claim 13, wherein the predetermined angular range is from zero to approximately 5 degrees.

15. The user support assembly of claim 11, wherein the horizontal pivot axis extends transversely through the user support to allow side to side swiveling motion of the user support in the unstable support mode.

16. The user support of assembly of claim 11, wherein the user support has at least one user support pad having a rear end, a forward end, and a central axis between the rear and forward ends, and the user support pad is configured for engagement by a user's knees and lower legs on opposite sides of the horizontal axis with the user in a kneeling position.

17. The user support assembly of claim 11, wherein the user support has at least one user support pad configured to support a user in a seated position.

18. The exercise machine of claim 11, wherein the locking device comprises a first lock part having an opening and a second part comprising a releasable locking pin movable between a locked position engaging the opening to prevent rotation of the user support about the horizontal pivot axis and an unlocked position retracted from the opening, one of the lock parts being associated with the user support and the other lock part being associated with the base.

19. The exercise machine of claim 18, wherein the user support includes a user support platform and a user support pad on top of the platform on which the user is supported during an exercise, the first lock part comprises a lock plate secured to the user support platform and extending downwards from the platform and the second part is mounted on the base.

20. The exercise machine of claim 18, wherein the first lock part is secured to the base and the second part is secured to the user support.

* * * * *